US005449421A

United States Patent [19]

Hamajima et al.

[11] Patent Number: 5,449,421

[45] Date of Patent: Sep. 12, 1995

[54] ALUMINUM ALLOY COMPOSITE MATERIAL WITH INTERMETALLIC COMPOUND FINELY DISPERSED IN MATRIX AMONG REINFORCING ELEMENTS

[75] Inventors: Kaneo Hamajima; Atsuo Tanaka; Tadashi Dohnomoto; Yoshio Fuwa; Hirohumi Michioka, all of Toyota, Japan

[73] Assignee: Toyota Jidosha Kabushiki Kaisha, Aichi, Japan

[21] Appl. No.: 660,221

[22] Filed: Feb. 20, 1991

Related U.S. Application Data

[63] Continuation of Ser. No. 320,284, Mar. 7, 1989, abandoned.

[30] Foreign Application Priority Data

| | | | |
|---|---|---|---|
| Mar. 9, 1988 | [JP] | Japan | 63-55870 |
| Mar. 9, 1988 | [JP] | Japan | 63-55872 |
| Mar. 9, 1988 | [JP] | Japan | 63-55873 |

[51] Int. Cl.[6] ..... C22C 21/00; C22C 32/00

[52] U.S. Cl. ..... 148/415; 428/614; 148/437

[58] Field of Search ..... 428/614, 650, 660; 420/590; 148/415, 437

[56] References Cited

U.S. PATENT DOCUMENTS

| | | | |
|---|---|---|---|
| 4,457,979 | 7/1984 | Donomoto et al. | 428/614 |
| 4,774,052 | 9/1988 | Nagle et al. | 420/590 |
| 5,015,534 | 5/1991 | Kampe et al. | 428/614 |

FOREIGN PATENT DOCUMENTS

| | | |
|---|---|---|
| 0115688 | 8/1984 | European Pat. Off. . |
| 59-218341 | 12/1984 | Japan . |
| 60-50137 | 3/1985 | Japan . |
| 60-50138 | 3/1985 | Japan . |
| 60-145340 | 7/1985 | Japan . |
| 61-132260 | 6/1986 | Japan . |
| 62-44547 | 2/1987 | Japan . |
| 62-124245 | 6/1987 | Japan . |
| 62-297425 | 12/1987 | Japan . |
| 63-169351 | 7/1988 | Japan . |
| 63-312901 | 12/1988 | Japan . |
| 2179369 | 3/1987 | United Kingdom . |

*Primary Examiner*—George Wyszomierski
*Attorney, Agent, or Firm*—Kenyon & Kenyon

[57] ABSTRACT

In an aluminum alloy composite material including an aluminum alloy matrix and a reinforcing material such as fibers, whisker or particles, intermetallic compounds made of Al and at least one selected from a group of Fe, Ni, Co, Cr, Cu, Mn, Mo, V, W, Ta, Nb, Ti and Zr are finely dispersed in the matrix existing among reinforcing material elements so as to maintain rigidity of the matrix alloy necessary to support the reinforcing material elements at high temperature. Optimum shapes and volumetric density of such intermetallic compounds are experimentally obtained.

31 Claims, 27 Drawing Sheets

ALUMINUM ALLOY COMPOSITE MATERIAL WITH INTERMETALLIC COMPOUND FINELY DISPERSED IN MATRIX AMONG REINFORCING ELEMENTS

This application is a continuation of application Ser. No. 07/320,284, filed Mar. 7, 1989, now abandoned.

BACKGROUND OF THE INVENTION

1. Field of the Invention

The present invention relates to a composite material, and more particularly, to a composite material comprising a matrix of an aluminum alloy and a reinforcing material such as short fibers, whisker or particles, and further to an aluminum alloy casting comprising a composite material portion made of a matrix of an aluminum alloy and a reinforcing material such as fibers, whisker or particles and having excellent thermal impact resistivity, strength, friction wear resistance and anti melt-adhesion resistance, and still further to a piston of an internal combustion engine made of such an aluminum alloy casting in which a heavily wearing portion is formed of such a composite material.

2. Description of the Prior Art

It has been widely researched to reinforce aluminum alloys with various reinforcing materials such as fibers, whisker or particles in order to improve the wear resistance of aluminum alloys while utilizing the light weigh merit of aluminum alloys. For example, it has been proposed to reinforce aluminum alloys with ceramic fibers, ceramic whisker, a three dimensional net structure of nickel, and cast iron fibers in Japanese Patent Laying-open Publications 58-9386, 57-70734, 59-218341 and 61-132260, respectively.

Those reinforced aluminum alloy composite materials generally exhibit excellent wear resistance superior to aluminum alloys. Although the above-mentioned aluminum alloy composite materials reinforced with ceramic fibers or ceramic whisker have excellent wear resistance, however, they bear a problem that the mating friction member is heavily worn by the hard ceramic reinforcing elements. On the other hand, although the aluminum alloy composite materials reinforced with a three dimensional net structure of nickel or cast iron fibers bear no such problem of heavy wearing of the mating friction member because these reinforcing materials have relatively low hardness, the composite materials by these reinforcing materials bear a problem that their own wear resistivity is not enough. By these prior art reinforced aluminum alloy composite materials, therefore, it is not possible to increase the wear resistance of the composite material members and also to decrease the friction wearing of the mating members.

As a result of extensive experimental researches with respect to the prior art reinforced aluminum alloy composite materials the inventors of the present application confirmed that, if, these prior art composite materials are used for a frictionally sliding member such as a piston of an internal combustion engine exposed to a relatively high temperature such as above 200° C., the aluminum alloy of the matrix melts and adheres to the frictionally sliding mating member, and causes heavy wearing in both of the mutually sliding members. It was also recognized that such melt-adhesion wearing is avoided when the aluminum alloy matrix is at low temperature because the matrix metal does not come into heavy direct contact with the mating member as it is supported by the reinforcing material elements, but when the matrix metal softens at high temperature, the reinforcing material elements are no longer firmly supported by the matrix metal and the matrix metal in turn comes into heavy direct contact with the mating member.

The phenomenon of melt-adhesion wearing was known, and in the art of reinforced metal composite material it was generally proposed, in order to avoid the melt-adhesion wearing, to increase the amount of reinforcing material such as fibers, whisker or particles. The inventors have conducted various experimental researches to confirm the effects of increasing the amount of reinforcing material on avoiding the melt-adhesion wearing. As a result, it was confirmed that if the amount of reinforcing material is increased, the wearing amount of the mating member inevitably increases, and that, because the matrix material exists in any event in the surface region of the composite material, it is not possible to completely avoid the melt-adhesion wearing.

The inventors of the present application have made various experimental researches on the above-mentioned problems with regard to the reinforced aluminum alloy composite materials, and found that the anti melt-adhesion characteristics of the reinforced aluminum alloy composite materials can be much improved without increasing the wearing amount of the mating member by providing the matrix of the reinforced aluminum alloy composite material with intermetallic compounds of Al and particular metallic elements as finely dispersed therein within a certain range of volumetric percentage.

In prior art researches on the reinforced aluminum alloy composite materials, it was generally understood that the matrix of the composite material should serve as a carrier for transmitting forces between reinforcing elements, and therefore the matrix must have relatively high tenacity. Therefore, a great deal of efforts have been spent to prevent or avoid the eduction of such intermetallic compounds in the matrix that would cause embrittlement of the matrix. However, as a result of various experimental researches conducted by the inventors of the present application, it was confirmed that it is significantly effective for improving the anti melt-adhesion resistance of the reinforced aluminum alloy composite materials at temperature above 200° C. to educt intermetallic compounds in the matrix, and by appropriately selecting the types and amounts of the intermetallic compounds, it is possible to obtain composite materials which have excellent wear resistance and anti melt-adhesion resistance at elevated temperature without increasing the wear amount of the mating members.

As described in the above-mentioned Japanese Patent Laying-open Publications 59-218341 and 61-132260, a composite material having an aluminum alloy matrix and including intermetallic compounds is known. However, in the prior art composite material the intermetallic compounds are formed only in a matrix portion around a net structure of reinforcing material or a mass of reinforcing fibers and not in the cell portions of the net structure or the void portions of the mass of reinforcing fibers. In other words, in the internal region of the composite material the matrix is made of only an aluminum alloy which would cause the melt-adhesion at high temperature such as above 200° C.

Since the intermetallic compounds are generally hard and brittle, it is unavoidable that the composite material becomes brittle as a result of inclusion of such intermetallic compounds. Particulary when such composite materials are subjected to severe heating and cooling cycles, cracks are often formed therein due to thermal fatigue.

The inventors of the present application have made various experimental researches to prevent cracks due to thermal fatigue to occur in the composite materials including intermetallic compounds, and found that it is possible to prevent such cracks to occur in an aluminum alloy casting having a surface portion formed of a composite material even under sever heating and cooling cycles and to improve strength of the composite material portion by controlling the shapes of the intermetallic compounds formed in the composite material portion.

In the piston of an internal combustion engine the top ring groove is apt to be easily abraded, and therefore it has been proposed and practiced to reinforce a portion around the top ring groove of the piston by compositely incorporating various types of reinforcing material therein. For example, in the above-mentioned Japanese Patent Laying-open Publication No. 58-9386 filed by the same assignee as the present application, it is described to compositely reinforce a portion around the top ring groove of a piston with ceramic fibers, and in the above-mentioned Japanese Patent Laying-open Publications Nos. 59-218341 and 61-132260 it is described to reinforce a portion around the top ring groove of a piston with a foamed metallic material and cast iron fibers, respectively.

In the above-described pistons in which a portion around the top ring groove is compositely reinforced with a reinforcing material, the wear resistance of the wall surface of the top ring groove and therefore the durability of the piston can be significantly improved as compared with a piston made of only an aluminum alloy. However, when such a piston is used at a relatively high temperature in order to improve the efficiency of the internal combustion engine, the wear at the wall surface of the top ring groove increases, and when the temperature of the wall surface of the top ring groove rises higher than 250° C., such a piston can only exhibit the same wear resistance as a piston made of only an aluminum alloy.

The inventors of the present application have carried out various kind of experiments using such prior art pistons, and found that if such pistons are used under severe thermal conditions such that the wall surface of the top ring groove is heated above 250 ° C., the aluminum alloy of the matrix tends to transfer to the top ring, and causes a melt-adhesion wearing on the lower surface of the top ring groove. It was also found that this melt-adhesive wearing occurs by the mechanism that, although at normal temperature the reinforcing material prevents the matrix alloy in the area close to the outer surface of the composite material portion of the piston to directly contact with the top ring, at an elevated temperature the aluminum alloy softens and the reinforcing material can not be appropriately supported by the matrix, so that the softened aluminum alloy comes into direct contact with the top ring,. Therefore, when such prior art pistons are used, it is required that the temperature around the top ring groove is kept below 220° C. at the highest, preferably below 200° C., and, therefore, this is one of the factors which limit the freedom of design of the pistons, in addition to the limits with regard to positioning the top ring groove, determining the dimensions of parts of the piston, forming the oil channels, etc..

Further the inventors of the present application found that in order to reduce the wear on the wall surface of the top ring groove at an elevated temperature such as 250° C. or more, it is required that the composite material should exhibit high wear resistance itself and ensure low wearing of the mating member, and for these purposes the composite materials should satisfy the following two conditions:

(a) The reinforcing material has a high rigidity enough to support the top ring at an elevated temperature.

(b) The matrix has a high thermal resistance at an elevated temperature enough to support the reinforcing material in an appropriate state with no substantial plastic deformation.

It was understood that these two properties are very important, and that the composite material described in the above-mentioned Japanese Patent Laying-open Publication No. 58-9386 is not sufficient in the condition (b), while the composite material described in the above Japanese Patent Laying-open Publications Nos. 59-218341 and 61-132260 are not sufficient in the condition (a).

The inventors of the present application have further conducted researches on the above problems and found that the pistons in which at least a lower surface portion of the top ring groove is defined by a composite material which comprises a matrix of an aluminum alloy and a reinforcing material of short fibers or whisker, tile aluminum alloy matrix including intermetallic compounds of aluminum and predetermined metal elements as finely dispersed therein, the volumetric ratios of the reinforcing material, the intermetallic compounds and the sum of the reinforcing material and the intermetallic compounds being at predetermined appropriate values, can exhibit highly improved wear resistance and melt-adhesion resistance in the lower surface of the top ring groove, without increasing the wear amount of the top ring, thereby enabling to minimize the weight of and to maximize the efficiency of the internal combustion engine.

SUMMARY OF THE INVENTION

In view of the above, a first object of the present invention is to provide, based on the matters found by the inventors as a result of various experimental researches, an aluminum alloy composite material which has high anti wear and anti melt-adhesion resistance at high temperature without increasing the wear of mating members and also retains the same or more tenacity than the prior art composite materials.

Further, a second object of the present invention is to provide, based on the results obtained by the researches, such an aluminum alloy casting which comprises a composite material portion formed of a matrix of an aluminum alloy and a reinforcing material of short fibers or whisker and defining a surface portion thereof, is immune to cracking due to thermal fatigue under relatively severe heating and cooling cycles, and has excellent mechanical characteristics such as strength, tenacity, wear resistance, and anti melt-adhesion resistance.

Further, a third object of the present invention is to provide, based on the results and knowledge obtained by the various experimental researches conducted by the inventors of the present application, a piston for an internal combustion engine which exhibits high wear resistance and high melt-adhesion resistance in the wall surface of the top ring groove and allows a high degree of freedom of piston design without increasing the wear of the mating top ring, thereby enabling to minimize the weight of and to maximize the efficiency of the internal combustion engine.

The above-mentioned first object is accomplished, according to the present invention, by an aluminum alloy composite material comprising a matrix of an aluminum alloy and a reinforcing material of short fibers, whisker or particles, said matrix including intermetallic compounds made of Al and al least one metallic element selected from a group consisting of Fe, Ni, Co, Cr, Cu, Mn, Mo, V, W, Ta, Nb, Ti and Zr as finely dispersed therein at 5–70% by volume.

According to this invention, the intermetallic compounds of Al and predetermined metallic elements are finely dispersed in an aluminum alloy matrix, and thereby the matrix material between adjacent reinforcing materials is reinforced and hardened by these intermetallic compound components so as to keep the reinforcing materials in a determinate condition even at an elevated temperature, and thereby it is prevented or avoided that the matrix material heavily directly contacts the mating member. Therefore, the composite material exhibits an improved anti wear resistance and an improved anti melt-adhesion resistance superior to the prior art composite materials. Further, since the volumetric ratio of the reinforcing material is not increased according to the present invention, the wear amount of the mating members is not increased. Although the intermetallic compounds are generally hard and brittle, since the matrix includes such intermetallic compounds in the range of 5–70% by volume as finely dispersed therein, the composite material according to the present invention has the same tenacity as or more tenacity than the prior art composite materials including no such intermetallic compounds.

According to a result of the experimental researches conducted by the inventors of the present application, it is indeed true with the composite material according to the present invention that if the volumetric amount of reinforcing material is not enough the anti wear and the anti melt-adhesion resistance of the composite material are not fully improved, while if the volumetric amount of reinforcing material is too much the wear amount of the mating member increases. Therefore, according to a feature of the present invention, the amount of reinforcing material should desirably be selected to be 3–30% by volume.

Further, according to a result of the experimental researches conducted by the inventors of the present application, the amount of the intermetallic compounds in the matrix may be 5–70% by volume, but preferably 10–40% by volume in order to further improve the anti melt-adhesion resistance of the composite material at elevated temperatures. Therefore, according to another feature of the present invention, the amount of the intermetallic compounds in the matrix should desirably be selected to be 10–40% by volume.

Further, according to a result of the experimental researches conducted by the inventors of the present application, it is desirable that the intermetallic compounds are dispersed as finely as possible in the matrix material, and the closest distance between two adjacent intermetallic compounds elements is less than 100 microns on an average, preferably less than 50 microns on an average. On the other hand, in order to avoid the embrittlement of the matrix this distance is required to be more than 3 microns on an average, preferably more than 5 microns. Therefore, according to still another feature of the present invention, the closest distance between the intermetallic compounds elements is selected to be 3–100 microns on an average, preferably 5–50 microns.

According to a result of the experimental researches conducted by the inventors of the present application, the intermetallic compound may be any intermetallic compound which is made of Al and one selected from the above-mentioned metal elements, and should preferably have a Vicker's hardness of more than 300 and less than that of the reinforcing material. Therefore, according to another feature of the present invention, the hardness of the intermetallic compound should be more than 300 in Vicker's hardness, and should be less than that of reinforcing material.

Further according to a result of the experimental researches conducted by the inventors of the present application, when the reinforcing material is short fibers or whisker, the amount of the intermetallic compounds should preferably be 3–80% by volume so as more significantly to improve the anti wear resistance of the composite material. Therefore, according to another feature of the present invention, the amount of the intermetallic compounds in the composite material is selected to be 3–80% by volume.

Further, according to a result of the experiments conducted by the inventors of the present application, when the intermetallic compounds are in the form of particles, the maximum particle size should preferably be less than 50 microns, more preferably less than 30 microns, and when the intermetallic compounds are formed in the form of needles, the maximum length should preferably be less than 100 microns, more preferably less than 50 microns.

According to the present invention any suitable materials which are commonly used in the manufacture of composite materials may be used as reinforcing material. The ceramic is a preferable material because it has an excellent stability at high temperature and provides an improvement of the anti wear resistance of the composite material.

Further, the above-mentioned second object is accomplished by an aluminum alloy casting comprising a composite material portion which defines a surface portion of said aluminum alloy casting, said composite material portion including a matrix of an aluminum alloy and a reinforcing material of short fibers or whisker, said matrix including an intermetallic compound made of Al and at least one metallic element selected from a group consisting of Fe, Ni, Co, Cr, Cu, Mn, Mo, V, W, Ta, Nb, Ti and Zr as finely dispersed therein, wherein as viewed in an optional section in a surface portion of the casting the ratio by area of such intermetallic compounds having a ratio of L/D greater than 3 is less than 30%, where L and D are length and width of each intermetallic compound element, respectively.

Since an aluminum alloy casting according to the present invention includes finely dispersed intermetallic compounds made of Al and predetermined metal elements in the matrix of its composite material portion so that the matrix material among reinforcing fibers or whisker elements is reinforced and fixed by the intermetallic compounds to hold the reinforcing material in a desired condition at an elevated temperature and to prevent the direct contact of the matrix with the mating members, the aluminum alloy casting exhibits much more improved strength, wear resistance and high temperature melt-adhesion resistance than the conventional composite materials including no such intermetallic compounds. Further, when the intermetallic compounds are so formed that they are in needle shapes having respective directions and the intermetallic compound elements having a ratio L/D of length L to width D thereof greater than 3 as viewed in an optional cross section in a surface portion of the composite material portion occupy less than 30% by area in the cross section, the aluminum alloy casting exhibits excellent thermal impact characteristics causing no cracks due to thermal fatigue in the composite material portion even under relatively severe heating and cooling cycles.

According to a result of the experimental researches conducted by the inventors of the present application, if a layer in which the amount of intermetallic compounds having a ratio L/D greater than 3 is less than 30% by area is formed as deep as more than 1 mm, more preferably more than 1.5 mm from the outside surface of the composite material portion, it is possible to definitely prevent the cracking due to thermal fatigue to occur in the composite material portion. Therefore, according to a feature of the present invention, the layer in which the intermetallic compounds having a ratio L/D greater than 3 occupy less than 30% by area should be formed as deep as more than 1 mm, more preferably more than 1.5 mm from the outside surface of the composite material portion.

According to a result of the experimental researches conducted by the inventors of the present application, if the volumetric amount of the reinforcing material is too small the wear resistance and melt-adhesion resistance of the composite material portion can not be improved, while if the volumetric amount of the reinforcing material is too much the wear of the mating members increases. Further, if the volumetric amount of the intermetallic compounds is insufficient, the melt-adhesion resistance of the composite material portion can not be fully improved, while if the volumetric amount of the intermetallic compounds is too much it causes serious embrittlement of the composite material portion thereby making it difficult to ensure a required strength. Therefore, according to another feature of the present invention the amount of the reinforcing material is selected to be 3–50% by volume, and the amount of the intermetallic compounds is selected to be 5–60% by volume.

According to a result of the experimental researches conducted by the inventors of the present application, it is desirable, in order to improve the strength, wear resistance and melt-adhesion resistance of the composite material portion, that the ratio of the needle shaped intermetallic compounds to the total amount of intermetallic compounds is high. Therefore, according to still another feature of the present invention, the composite material portion is formed to include the intermetallic compounds so that the intermetallic compounds having a ratio L/D greater than 3 occupy more than 20% by area, preferably more than 40% by area as viewed in an optional cross section thereof.

According to a result of the experimental researches conducted by the inventors of the present application, it is desirable that the intermetallic compounds are as finely dispersed as possible, and the closest distance between two adjacent intermetallic compounds is less than 100 microns on an average, preferably less than 50 microns on an average. However, in order to avoid embrittlement of the matrix the closest distance is desired to be more than 3 microns on an average, preferably more than 5 microns on an average. Therefore, according to another feature of the present invention, the closest distance between each two adjacent intermetallic compounds should desirably be selected to be 3–100 microns on an average, preferably 5–50 microns on an average.

According to a result of the experimental researches conducted by by the inventors of the present application, the intermetallic compounds may be any intermetallic compound which is made of Al and the above-mentioned metal elements, but should preferably have a Vicker's hardness more than 300 and less than that of the reinforcing material. Therefore, according to another feature of the present invention, the hardness of the intermetallic compounds should be more than 300 by Vicker's hardness and less than that of the reinforcing material.

Further, according to a result of the experimental researches conducted by the inventors of the present application, when the intermetallic compounds are particles, the maximum diameter should preferably be less than 50 microns, more preferably less than 30 microns, and when the intermetallic compounds are needles, the maximum length should preferably be less than 100 microns, more preferably less than 50 microns.

Any suitable materials which are commonly used in manufacturing the composite materials may be used for the reinforcing material, but ceramics are preferred materials for the excellent effect in improving wear resistance and high temperature stability.

Further, the above-mentioned third object is accomplished, according to the present invention, by a piston for an internal combustion engine made of a fiber reinforced aluminum alloy, wherein at least a lower surface of a top ring groove is defined by a composite material including a matrix of an aluminum alloy and a reinforcing material of short fibers or whisker, said matrix of the composite material including as finely dispersed therein intermetallic compounds of Al and at least element selected from a group consisting of Fe, Ni, Co, Cr, Cu, Mn, Mo, V, W, Ta, Nb, Ti and Zr, the amount of said reinforcement material in said composite material being more than 3% by volume, the amount of said intermetallic compounds being 10–50% by volume, and the total amount of said reinforcing material and said intermetallic compounds being less than 60% by volume.

According to the present invention, the intermetallic compounds of Al and other desired metallic elements are finely dispersed in the aluminum alloy matrix material, and therefore the matrix material between the reinforcing material elements is reinforced and fixed by these intermetallic compounds so as to hold the reinforcing material elements in a desired condition at an elevated temperature, and therefore it is prevented that the matrix material comes into direct contact with the top ring, and thus the wear resistance and melt-adhesion resistance of the wall surface of the top ring groove are much improved as compared to the prior art. By selecting the amount of the reinforcing material and the intermetallic compounds to certain predetermined values it is possible to avoid any increase of the wear of the mating top ring.

According to a result of the experimental researches conducted by the inventors of the present application, if the volumetric amount of reinforcing material included in the composite portion of the piston is too small, a sufficient improvement of the wear resistance and the melt-adhesion resistance on the lower surface of the top ring groove is not available, while if the volumetric amount of reinforcing material is too much the wear in the mating top ring increases, and it becomes difficult to form the top ring groove by machining. According to a preferred embodiment of the present invention, the amount of reinforcing material is 3–40% by volume, preferably 3–30% by volume.

Further, according to a result of the experimental researches conducted by the inventors of the present application, the intermetallic compound may be any intermetallic compound which is formed of Al and one or more of the above-mentioned metal elements, but it is desirable that the amount of the intermetallic compounds of Al and one or more of Fe, Co and Ni is more than 50% by volume of the total amount of intermetallic compounds, and that the amount of these intermetallic compounds is more than 10% by volume of the total amount of composite material. Therefore, according to another feature of the present invention, the amount of the intermetallic compounds which are made of Al and one or more metal elements selected from Fe, Co and Ni should preferably be more than 50% of the intermetallic compounds by volume, and the amount thereof should preferably be more than 10% of the composite material by volume.

Further, according to a result of the experimental researches conducted by the inventors of the present application, it is desirable that the intermetallic compounds are dispersed as finely as possible in the matrix material, and that he closest distance between two adjacent intermetallic compound elements is less than 100 microns on an average, more preferably less than 50 microns on an average. Further, in order to avoid embrittlement of the matrix it is desirable that this distance is more than 3 microns on an average, more preferably 5 microns. Therefore, according to another feature of the present invention, the closest distance between two adjacent intermetallic compound elements is selected to be 3–100 microns on an average, more preferably 5–50 microns.

According to a result of the experiments by the inventors of the present invention, when the intermetallic compounds are formed as particles, it is desirable that the maximum particle size is less than 50 microns, preferably less than 30 microns, and when the intermetallic compounds are formed as a needle form, it is desirable that the maximum length thereof is less than 100 microns, preferably 50 microns.

Further, according to a result of the experimental researches conducted by the inventors of the present application, when the intermetallic compounds are in the form of particles, it is desirable that the maximum grain size is 50 microns, more preferably 30 microns, and when the intermetallic compound are in the form of needles, the maximum length thereof is 100 microns, more preferably 50 microns.

The reinforcing material in the composite material may any suitable material commonly used in manufacturing composite materials, but ceramics are preferable because they can improve the wear resistance and the stability at elevated temperature.

In the present specification and the appended claims, "volumetric ratio of the intermetallic compounds in the matrix" or "amount of the intermetallic compounds in the matrix by volume" means the volumetric amount in percentage of the intermetallic compounds relative to the total volume of the materials in the composite material other than the reinforcing material, and "volumetric ratio of the intermetallic compounds in the composite material" or "amount of the intermetallic compounds in the composite material by volume" means the volumetric amount in percentage of the intermetallic compounds relative to the whole amount of the composite material.

BRIEF DESCRIPTION OF THE DRAWINGS

In the accompanying drawings.

DESCRIPTION OF THE PREFERRED EMBODIMENTS

Hereinafter some embodiments of the present invention are described in detail by reference to the accompanying drawings.

Example 1

As shown in Table 1, eight different porous molded bodies were formed by a suction molding method, comprising respectively 10% by volume alumina short fibers of 2 mm diameter on an average (95% $Al_2O_3$, 5% $SiO_2$, "SUFFIL RF" from ICI), and 0%, 1%, 2%, 5%, 7%, 10%, 15% and 18% by volume Ni powder (purity 99%) of 5 microns particle size on an average. Each molded body had a cylindrical form of 100 mm diameter and 20 mm height, and the fibers and the powder therein were substantially uniformly mixed with one another in the molded bodies.

Figure 1:
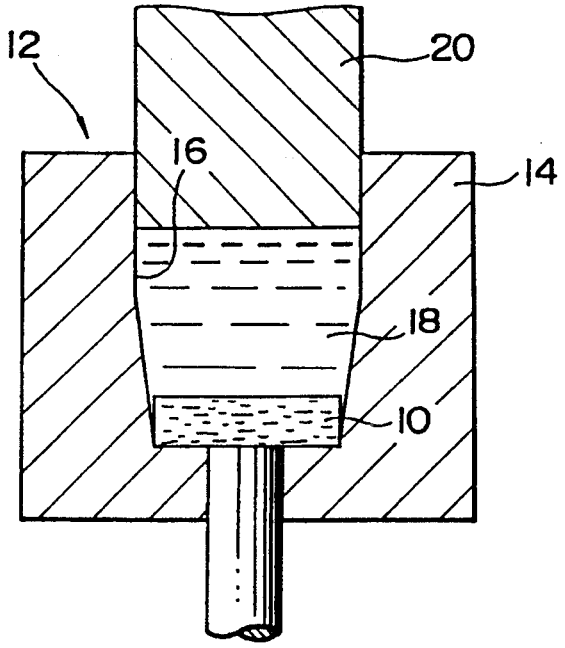
FIG. 1 is a partial sectional view of a high pressure casting apparatus, by which the composite material according to the present invention was formed.

The molded bodies were each preheated to 500° C. in an atmosphere of nitrogen gas, and then placed in and fitted on the bottom of the mold cavity 16 of the mold 14 of a high pressure casting apparatus 12, as shown in FIG. 1. Then, molten aluminum alloy 18 (JIS-ACIA, 4.5% Cu, 1% Si, balance substantially Al) at 800° C. was poured into the mold cavity, and was pressed to and maintained at a pressure of 1000 kg/cm$^2$ by a plunger 20, until the molten aluminum alloy was completely solidified.

Figure 2:
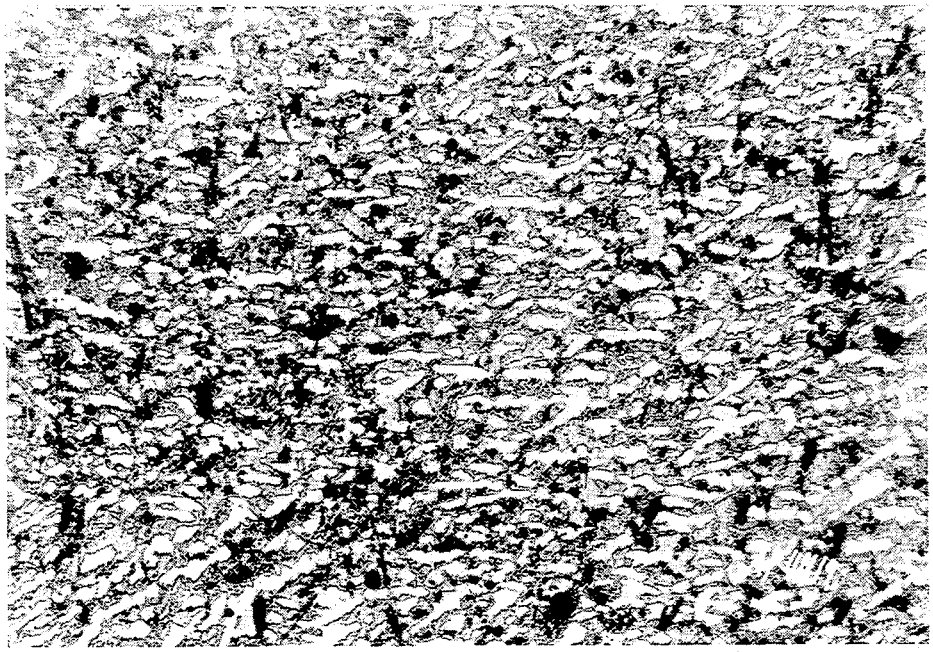
FIG. 2 and FIG. 3 are microphotographs at 100× and 400× magnifications of the cross sections of the composite material according to the present invention, showing finely dispersed intermetallic compound $NiAl_3$.
Figure 3:
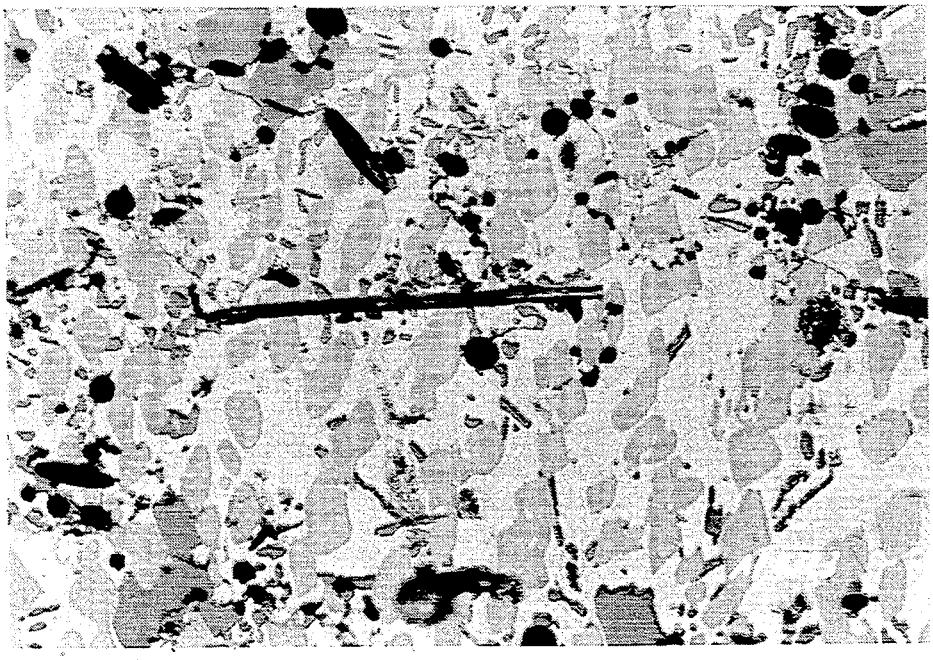

From the cast bodies thus obtained composite materials No. 1–8 were prepared by cutting out a portion thereof which was in the region of the original molded body, and each composite material was subjected to microscopic observation of the composite structure in section. It was revealed that in the composite materials No. 2–8 which were prepared from the molded bodies including Ni powder the matrix included finely dispersed Al-Ni intermetallic compounds. By X-ray diffraction analysis it was found that these intermetallic compounds were $NiAl_3$ or a combination of $NiAl_3$ and $Ni_2Al_3$, and by an image analysis it was recognized that as the amount of Ni powder in an original molded body increases, the amount of the intermetallic compounds also increases. Table 1 shows types and volumetric ratio of the intermetallic compounds in the matrix formed by the composite materials No. 1–8. FIG. 2 and FIG. 3 are microphotographs of cross sections of the composite material No. 4 by 100× and 400× magnification, wherein white and gray portions are $NiAl_3$ and black portions are alumina short fibers.

After the $T_7$ heat treatment of these composite materials, melt-adhesion test pieces in a disc form of 90 mm diameter and 10 mm height, tension test pieces having a parallel portion of 14 mm length and 14 mm diameter, and wear test pieces of 16×6×10 mm were prepared from these composite materials. These test pieces were then subjected to melt-adhesion tests and tension tests at 250° C. and wear tests at room temperature.

The melt-adhesion tests were carried out by using these test pieces and mating members which were C-shaped members made of stainless steel (JIS-SUS 440A: 18% Cr, 0.5% Mo, 0.7% C, balance Fe) having 82 mm outer diameter, 76 mm inner diameter and 2 mm height, by pressing each of the melt-adhesion test pieces against the mating member at 250° C. and at a cyclic pressure of 10 kgf/cm$^2$, 10 Hz and 5 mm stroke for 30 minutes. Thereafter, each test piece was examined to measure the area (mm$^2$) of the melt-adhesion formed on the contact surface by image analysis.

The tension tests were also carried out at 250° C. by a method used in common, and a tensile strength of each test piece was determined by dividing a maximum tensile load on the test piece by the initial sectional area of the parallel portion of the test piece.

Further the wear tests were carried out about the above-mentioned wear test pieces by using cylindrical test pieces made of carburized and quenched bearing steel (Hv 720 in surface hardness ) having 35 mm outer diameter, 30 mm inner diameter and 10 mm height, contacting a wear test piece to the outer surface of the cylindrical test piece, with the contact area therebetween being supplied with lubricating oil (SAE 10W-30) at room temperature (20° C.), and rotating the cylindrical test piece at a contact pressure of 60 kg/mm$^2$ and a sliding speed of 0.3 m/sec for one hour.

Figure 4:
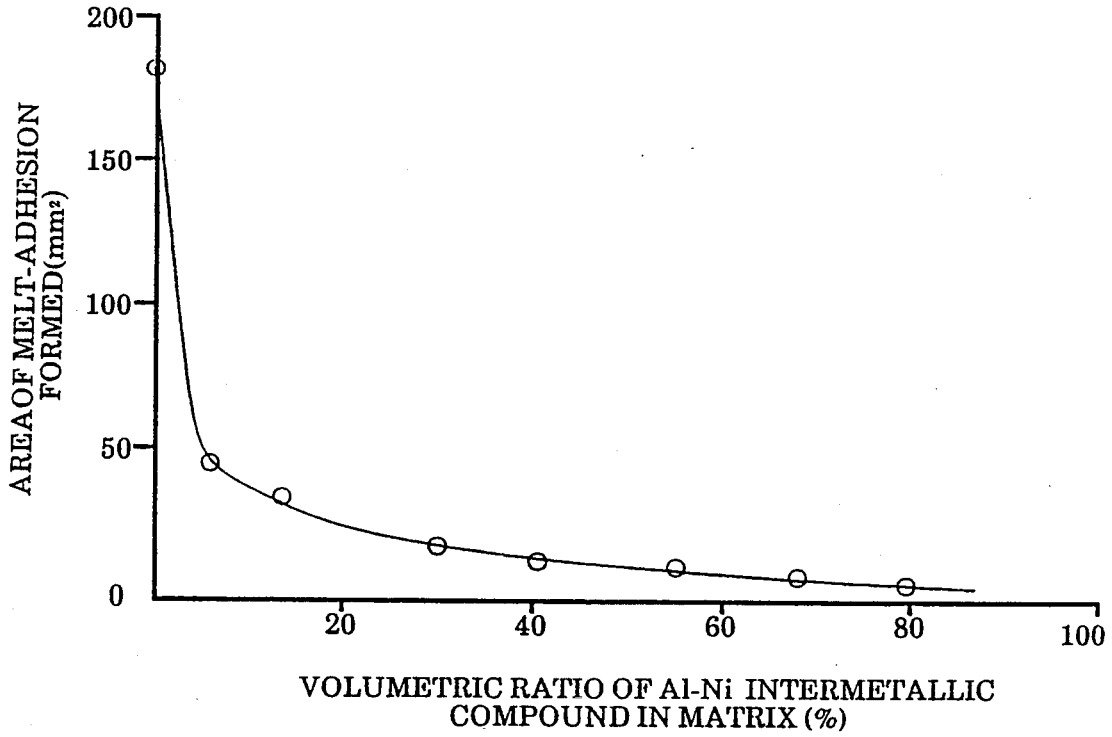
FIGS. 4–6 are graphs showing the results of the melt-adhesion tests at 250° C., the tension tests at 250° C., and the wear tests at room temperature of the composite materials of Example 1.
Figure 5:
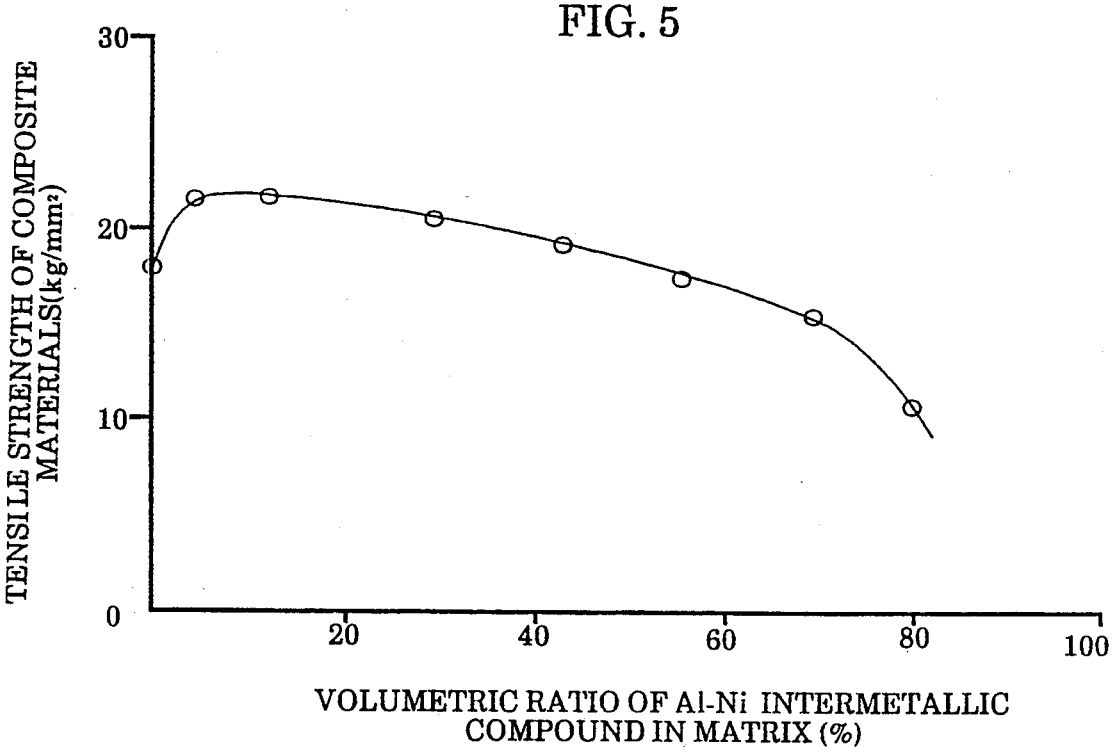
Figure 6:
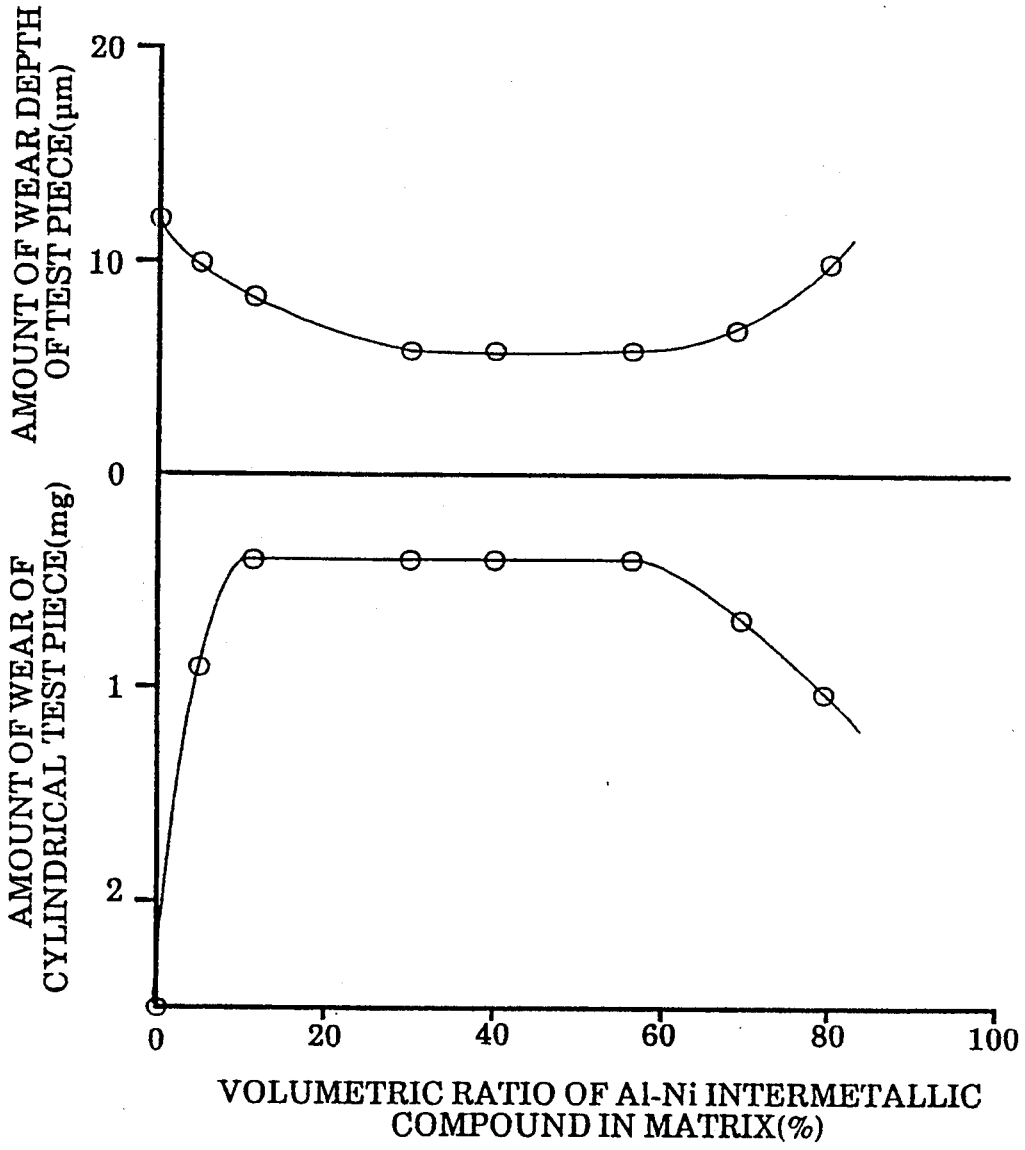

The results of these tests are shown in FIGS. 4–6. In FIG. 6 (also in FIG. 13, FIGS. 21–23, and FIG. 25), the upper half of the graph shows the amount of wear depth (microns) of the wear test pieces, and the lower half of the graph shows the amount of wear (mg) of the mating cylindrical test pieces.

From FIG. 4 it will be understood that if the amount of the intermetallic compounds in the matrix is more than 5% by volume, particularly more than 10% by volume, the area of melt-adhesion is significantly reduced. It will be also understood from FIG. 5 that if the amount of the intermetallic compounds in the matrix is 5–70% by volume, particularly 10–40% by volume, these composite materials exhibit relatively high tensile strength. Further from FIG. 6, it will be understood that if the amount of the intermetallic compounds in the matrix is 5–70% by volume, particularly 10–55% by volume, the amount of wear on both the composite material and the mating member is low. According to the results of the tests, it will be appreciated that the amount of the intermetallic compounds in the matrix should preferably be 5–70% by volume, more preferably 10–40% by volume in order to obtain the composite materials which are excellent in the anti melt-adhesion resistance, tenacity, and wear resistance.

Example 2

As shown in Table 2 the composite materials Nos. 9–14 were prepared by using the same method and under the same conditions as those in Example 1, except that the molded bodies included Ni powder of 0% and 3% by volume, alloys filled in the molded bodies were aluminum alloy for rolling (JIS-7075: 5.5% Zn, 2.5% Mg, 1.5% Cu, balance Al), aluminum alloy for casting (JIS-AC8:12% Si, 1% Cu, 1% Mg, 1% Ni, balance Al), and aluminum alloy for die casting (JIS-ADC10:8% Si, 3% Cu, balance Al), and these molten alloys were heated at temperatures of 800° C., 740° C. and 720° C., respectively. Further, the composite material No. 9 was heat treated by the $T_6$ heat treatment instead of the $T_7$ heat treatment.

In each composite material prepared by the above-mentioned method, the types and the amounts of the intermetallic compounds in the matrix were determined by the same method as used in Example 1. According to a result of these tests it was recognized, as shown in Table 2, that in the composite materials Nos. 9–11 including no Ni powder, no intermetallic compounds were formed, while in the composite materials Nos. 12–14 including Ni powder of 3% by volume, $NiAl_3$ of about 18% by volume was formed in finely dispersed condition.

Each composite material prepared by the above-mentioned method was subjected to the melt-adhesion tests and the tension tests at 250° C. according to the same method and under the same conditions as those in Example 1. The results of these tests are shown in FIG. 7 and FIG. 8.

Figure 7:
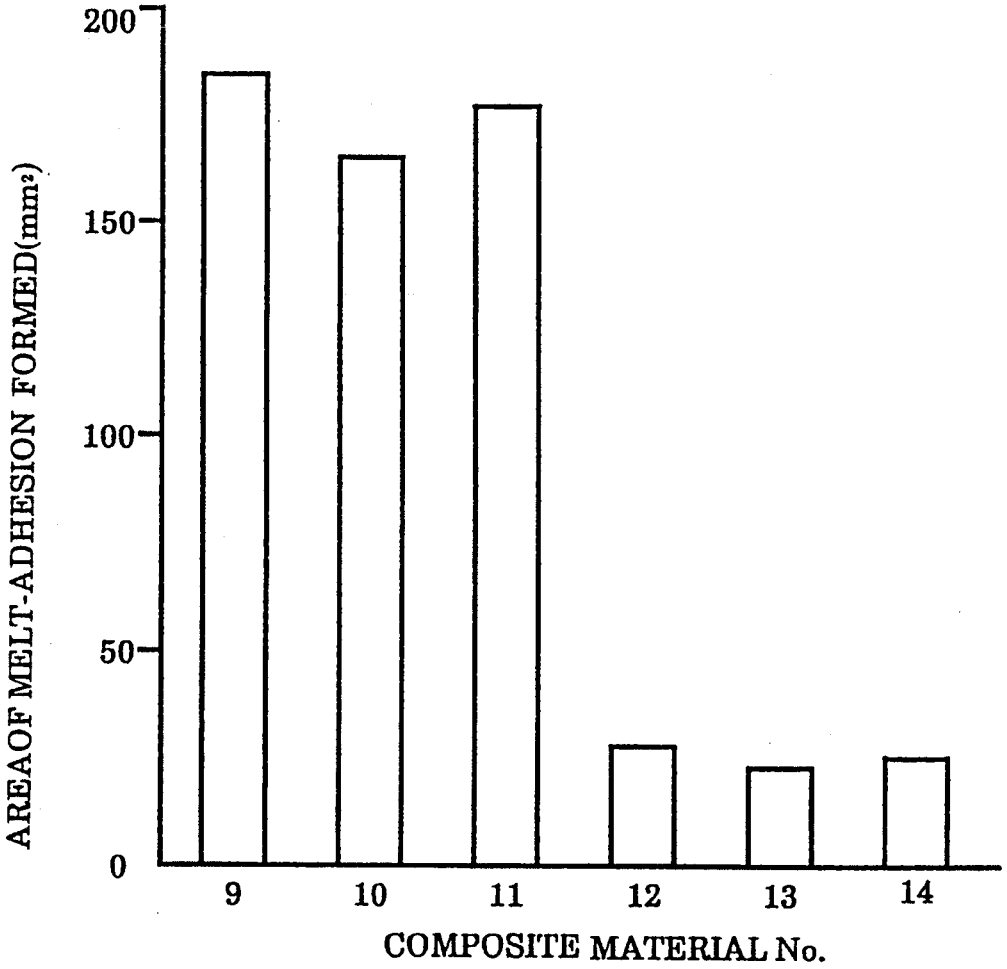
FIGS. 7 and 8 are graphs showing the results of the melt-adhesion tests and the tension tests at 250° C. of the composite materials of Example 2.
Figure 8:
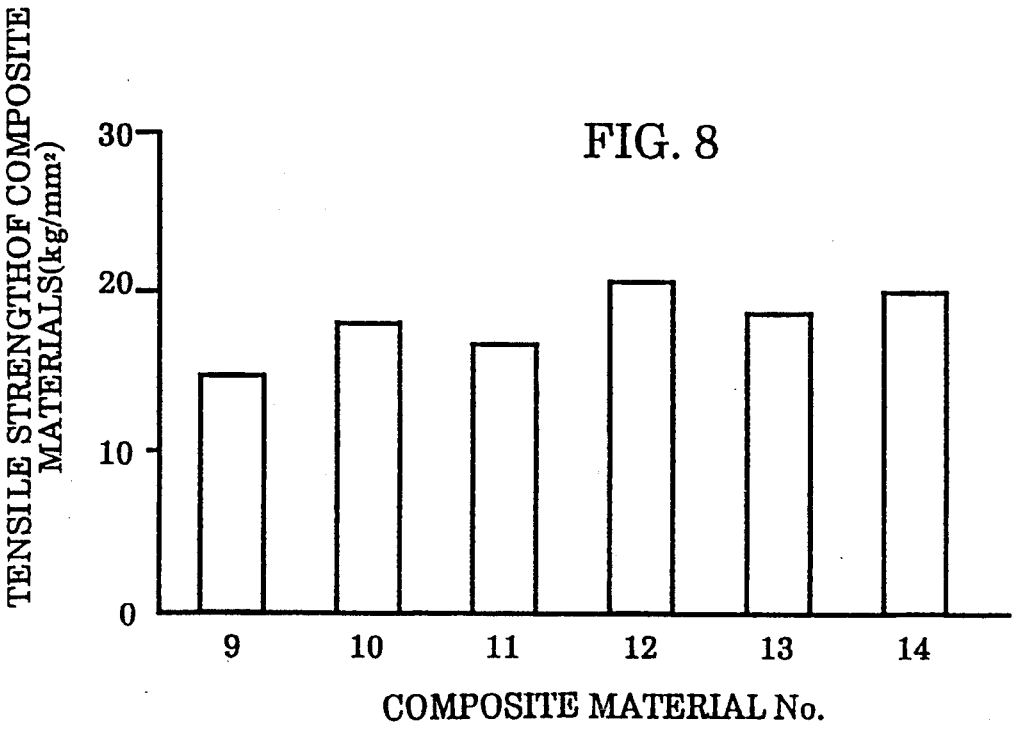

From FIG. 7 it will be understood that when these aluminum alloys are used as the matrix metal, the composite materials including the finely dispersed intermetallic compounds in its matrix also exhibit much more excellent anti melt-adhesion resistance than the prior art composite materials including no such intermetallic compounds in the matrix. From FIG. 8 it will be also understood that the tensile strength of the composite materials including the finely dispersed intermetallic compounds in the matrix is the same as or more than that of the prior art composite materials including no such intermetallic compounds in the matrix.

From the results of these tests,it will be understood that the matrix alloy may be any alloy which includes Al as a base component, and it is guessed that aluminum alloys for rolling such as JIS-2015, 3003, 4043, 5052, etc., aluminum alloy for casting such as JIS-AC2B, AC4C, AC7A, etc., and aluminum alloy for die casting such as JIS-ADC1, ADC3, ADC7, etc. may provide almost the same results.

Example 3

Composite materials Nos. 15–20 were prepared by the same method and under the same conditions as those in Example 1, except that six different molded bodies were prepared to include 10% by volume alumina-silica short fibers (55% $Al_2O_3$, 45% $SiO_2$) of 3 mm fiber length on an average and 3 microns fiber diameter on an average, 15% by volume silicon carbide whisker (98% beta-SiC) of 10–200 microns fiber length and 0.05–1 micron fiber diameter, and 30% by volume silicon nitride particles (99% alpha-$Si_3N_4$) of 1 micron particle size on an average, respectively, as the reinforcing material, Ni powder of 0% and 5% by volume, respectively, as the additive element, and aluminum alloy (JIS-5056:5% Mg, 0.4% Fe, 0.3% Si, 0.1% Cu, balance Al) as the matrix, the molten aluminum alloy being heated to 800° C. Each composite material was heat treated by such a manner that each composite material was kept at 400° C. for three hours and then cooled in a furnace, instead of the $T_7$ heat treatment.

The types and the amounts of the intermetallic compounds in the matrix of each composite material were then determined by the same method as used in Example 1. As shown in Table 3, in the composite materials Nos. 15–17 formed without Ni powder no intermetallic compounds were formed in the matrix, while in the composite materials Nos. 18–20 formed with 5% by volume Ni powder, $NiAl_3$ of about 30% by volume was formed in the matrix as finely dispersed therein.

Each composite material prepared by the above-mentioned method was subjected to the melt-adhesion tests and the tension tests at 250° C. according to the same method and under the same conditions as those in Example 1. The results of these tests are shown in FIG. 9 and FIG. 10.

Figure 9:
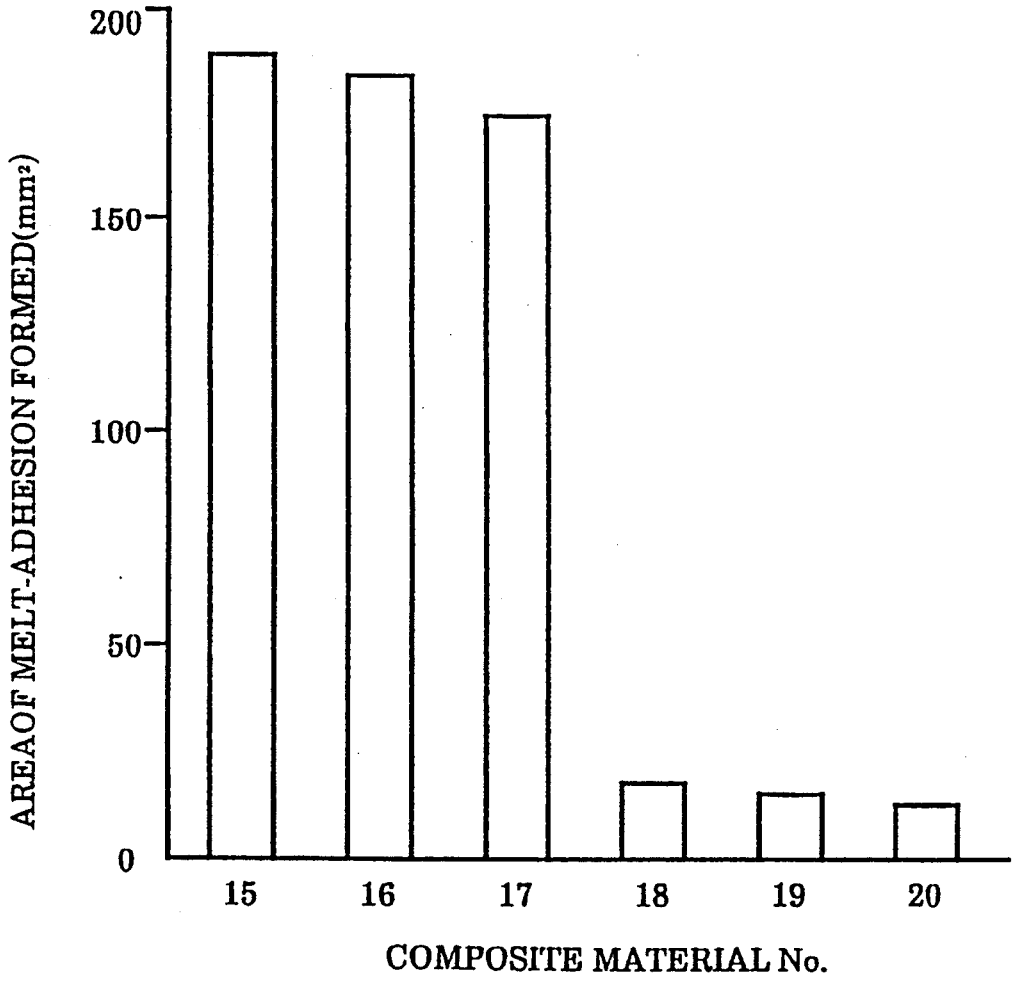
FIGS. 9 and 10 are graphs showing the results of the melt-adhesion tests and the tension tests at 250° C. of the composite material of Example 3.
Figure 10:
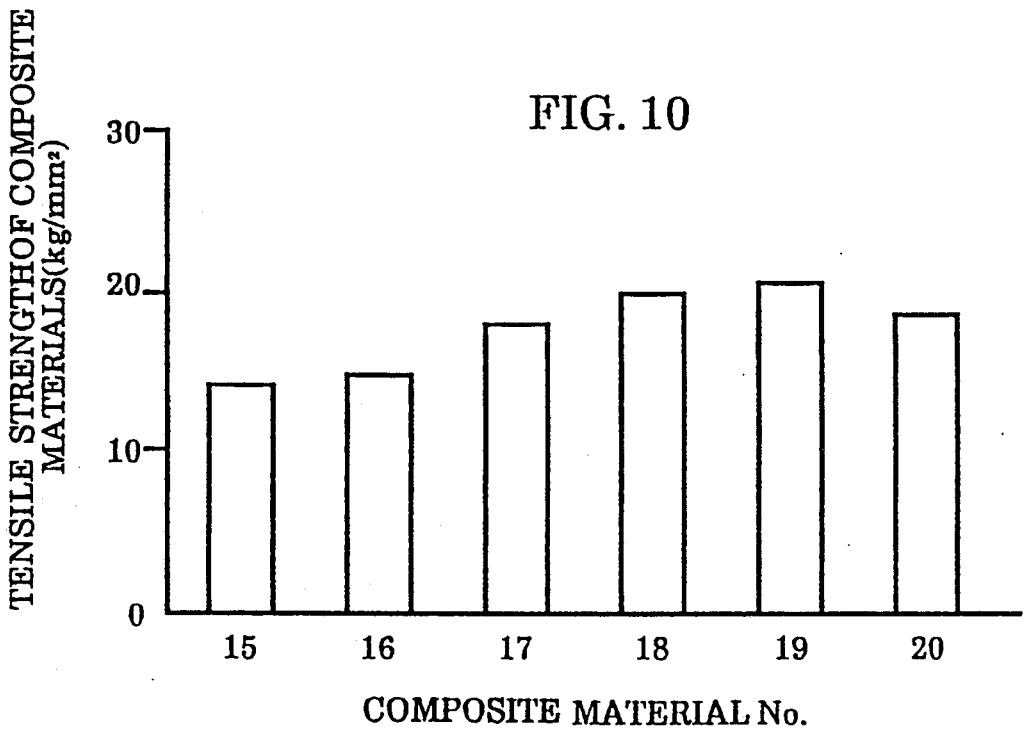

From FIG. 9, it will be understood that when the reinforcing material is not alumina short fibers, the composite material including the finely dispersed intermetallic compounds in the matrix also exhibit much more excellent anti melt-adhesion resistance than the prior art composite materials including no such intermetallic compounds in the matrix. From FIG. 10, it will also be understood that the tensile strength of the composite materials including the finely dispersed intermetallic compounds in the matrix is the same as or more than that of the prior art composite materials including no such intermetallic compounds in the matrix.

According to the results of these tests, the reinforcing material may be either fibers or particles. Further, according to the results of these tests, the reinforcing material may be any fibers, whisker or particles as far as they have an excellent wear resistance and a stability at an elevated temperature. Such fibers may include short fibers, so called "chopped fibers", which are made by cutting glass fibers, alumina long fibers, silicon carbide long fibers, and Si-Ti-C long fibers, whisker such as silicon nitride whisker, alumina whisker, and potassium titanate whisker, and particles such as alumina particles, zirconia particles, silicon carbide particles, tungsten carbide particles and boron nitride particles.

Example 4

As shown in Table 4, composite materials Nos. 21–25 were prepared according to the same method and under the same conditions as those in Example 1, except that five different molded bodies included 10% by volume silicon nitride whisker (97% alpha-$Si_3N_4$) of 50–300 microns fiber length and 0.1–0.5 micron fiber diameter as the reinforcing material, and four of the five molded bodies included further 5% by volume Fe powder (purity 99%) of 5 microns particle size on an average, 3% by volume Co powder (purity 99%) of 5 microns particle size on an average, 3% by volume Mn powder (purity 98%) of 10 microns particle size on an average, and 7% by volume Ti powder (purity 99%) of 8 microns particle size on an average, respectively, while one molded body for the composite material No. 21 included only 10% by volume silicon nitride whisker, and using molten aluminum alloy (JIS-AC5A: 4% Cu, 1.5% Mg, 2% Ni, balance Al) at 760° C.

The types and the amounts of the intermetallic compounds in the matrix of each composite material were determined by using the same method as in Example 1. As shown in Table 4, in the composite material No. 21 no intermetallic compounds were produced in the matrix, while in the composite materials Nos. 22–25 $FeAl_3$, $Co_2Al_9$, $MnAl_6$ or $TiAl_3$ of about 30% by volume were formed in the matrices as finely dispersed therein.

Each composite material was also subjected to the melt-adhesion tests and the tension tests at 250° C., and the wear tests at room temperature according to the same method and under the same conditions as those in Example 1. The results of these tests are shown in FIGS. 11–13.

Figure 11:
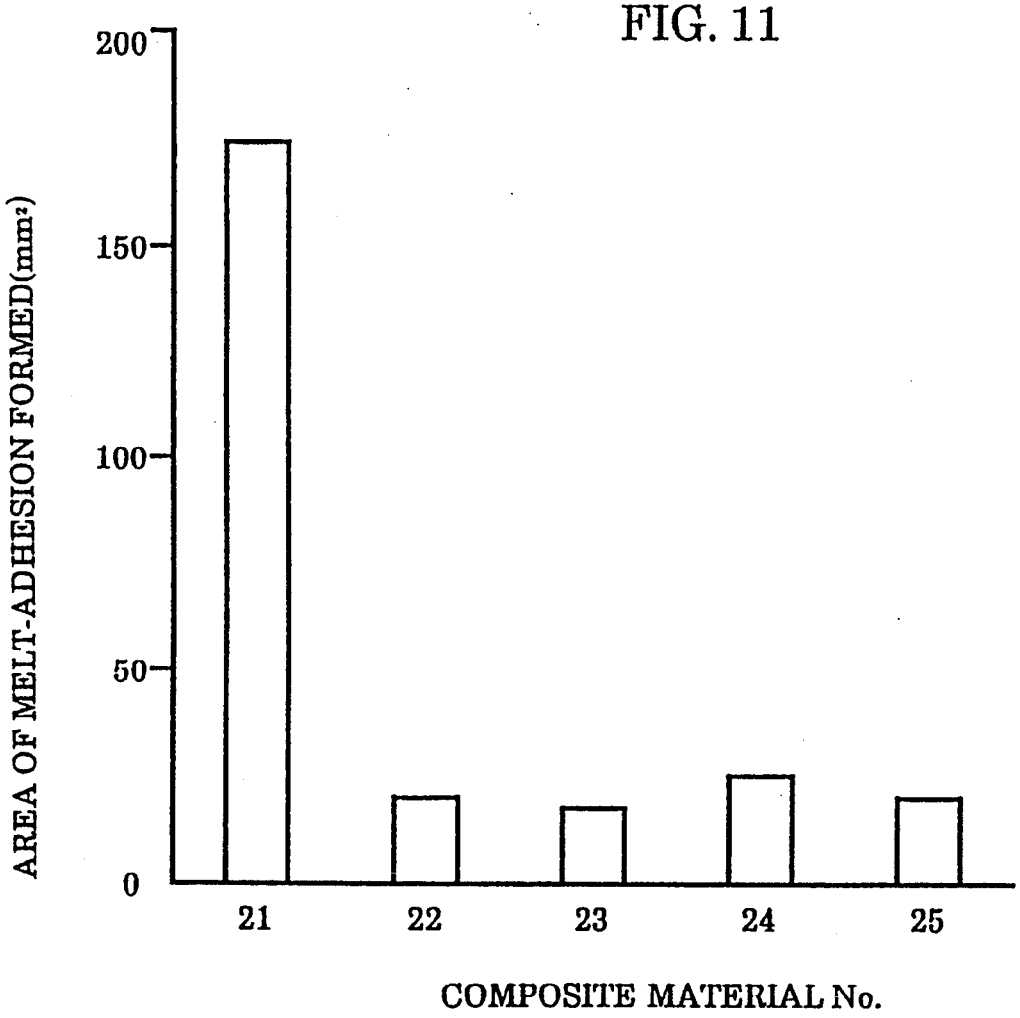
FIGS. 11–13 are graphs showing the results of the melt-adhesion tests at 250° C., the tension tests at 250° C., and the wear tests at room temperature of the composite material of Example 4.
Figure 12:
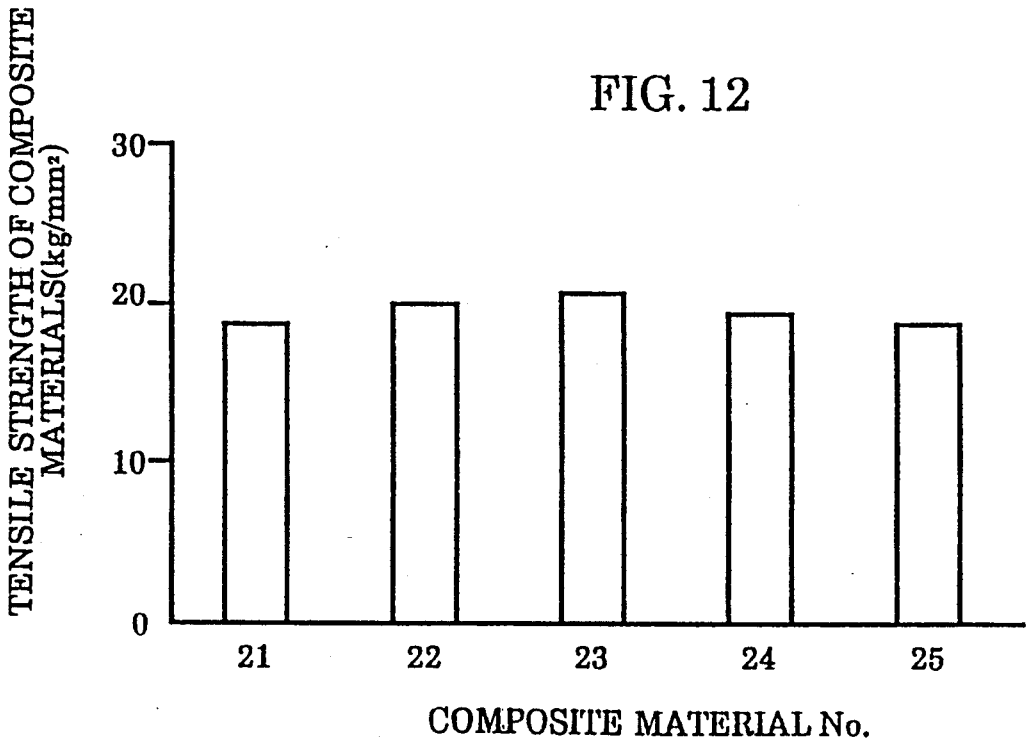
Figure 13:
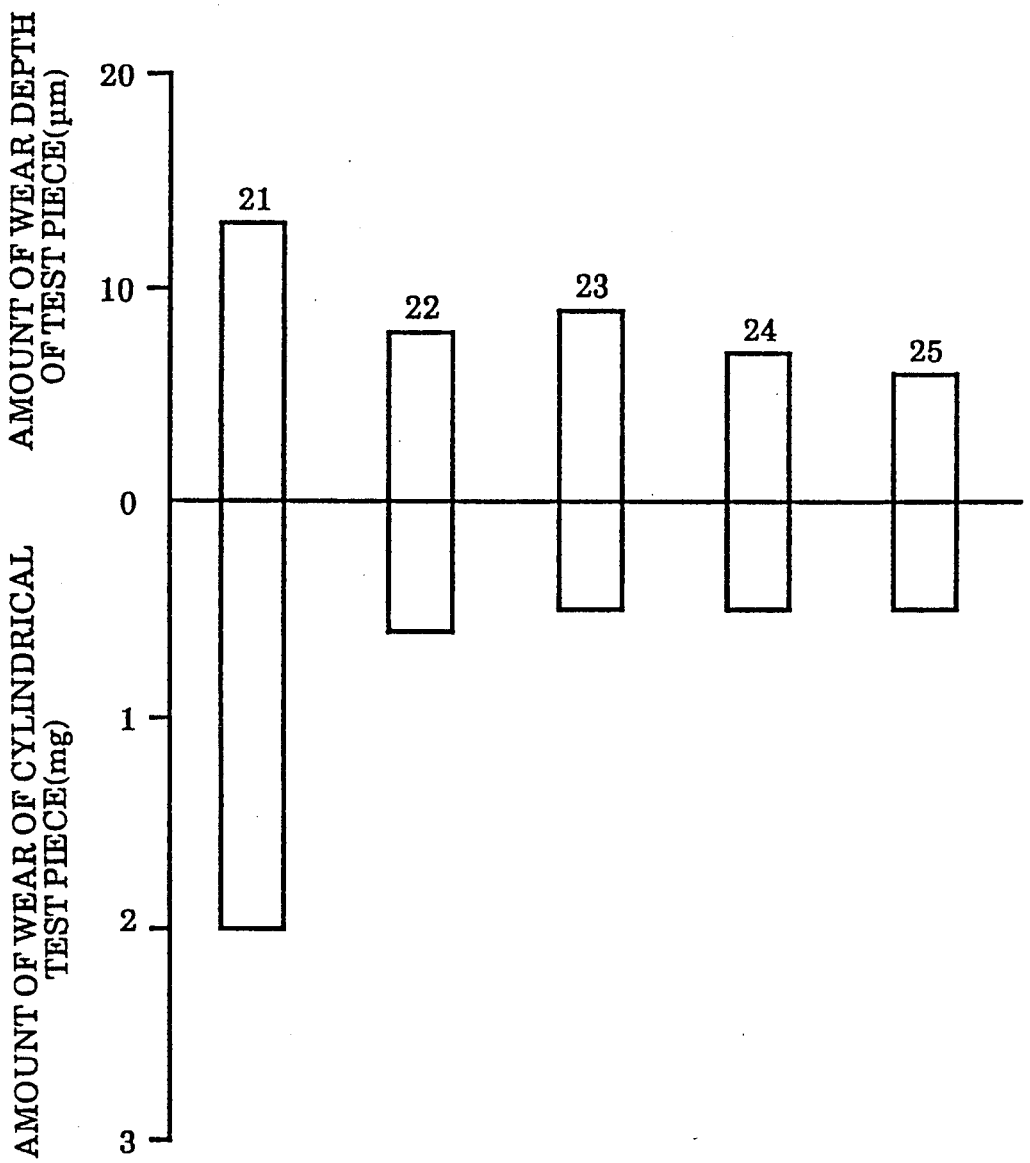

From FIG. 11 and FIG. 13 it will be understood that when the intermetallic compounds are $FeAl_3$, etc., the composite materials including the finely dispersed intermetallic compounds in the matrix exhibit much more excellent anti melt-adhesion resistance and wear resistance than the prior art composite material including no such intermetallic compound in the matrix. Further, FIG. 12 shows that the tensile strength of the composite materials including the finely dispersed intermetallic compounds in the matrix is the same as or more than that of the prior art composite material which includes no such intermetallic compounds in the matrix.

As shown in Table 9 composite materials were prepared to include finely dispersed intermetallic compounds of about 30% by volume in the matrix by using Cr powder, Mo powder, V powder, W powder, Ta powder, Nb powder, Zr powder and Cu powder, and these composite materials were subjected to the melt-adhesion tests at 250° C. according to the same method and under the same conditions as those in Example 1. Further, composite materials including intermetallic compounds as shown in Table 10 were also subjected to the melt-adhesion tests at 250° C. according to the same method and under the same conditions as those in Example 1. It was found that with these intermetallic compounds the composite materials also exhibit more excellent anti melt-adhesion resistance than the prior art composite materials.

From the results of these tests, it will be understood that the intermetallic compounds to be formed in the matrix may be any intermetallic compound which consists of Al and one or more metal elements such as the above-mentioned metal elements having a high melting point. Each of these intermetallic compounds had a Vicker's hardness of more than 200° at 250° C. and an excellent thermal resistance.

Example 5

As is shown in Table 5, composite materials Nos. 26–30 were prepared according to the same method and under the same conditions, except that five molded bodies included 30% by volume $Al_2O_3$ particles (99% alpha-$Al_2O_3$, 1 micron particle size on an average) as the reinforcing material, and four of the five molded bodies included further 3% by volume Fe-Mn alloy powder (50% Fe, 50% Mn, 10 microns particle size on an average), 1.64 by volume Ni-Fe alloy powder (50% Ni, 50% Fe, 10 microns particle size on an average), 7.8% by volume Ni-Cu alloy powder (50% Ni, 50% Cu, 10 microns particle size on an average), and 9.34 by volume Cu-Zn powder (70% Cu, 30% Zn, 10 microns particle size on an average), respectively, while one molded body for the composite material No. 26 included only 30% by volume $Al_2O_3$ particles, and using molten aluminum alloy (JIS-ADC7: 5% Si, balance substantially Al) at 720° C. The types and the amounts of the intermetallic compounds in each matrix were determined by the same method as those in Example 1. As shown in Table 5, in the composite material No. 26 formed with no alloy powder no intermetallic compounds were formed in the matrix, while in the composite materials Nos. 27–30 formed with alloy powder the intermetallic compounds of about 30% by volume corresponding to the additional alloy powder were formed as finely dispersed therein.

Each composite material was subjected to the melt-adhesion test and the tension test at 250° C. according to the same method and under the same conditions as those in Example 1. The results of these tests are shown in FIG. 14 and FIG. 15.

Figure 14:
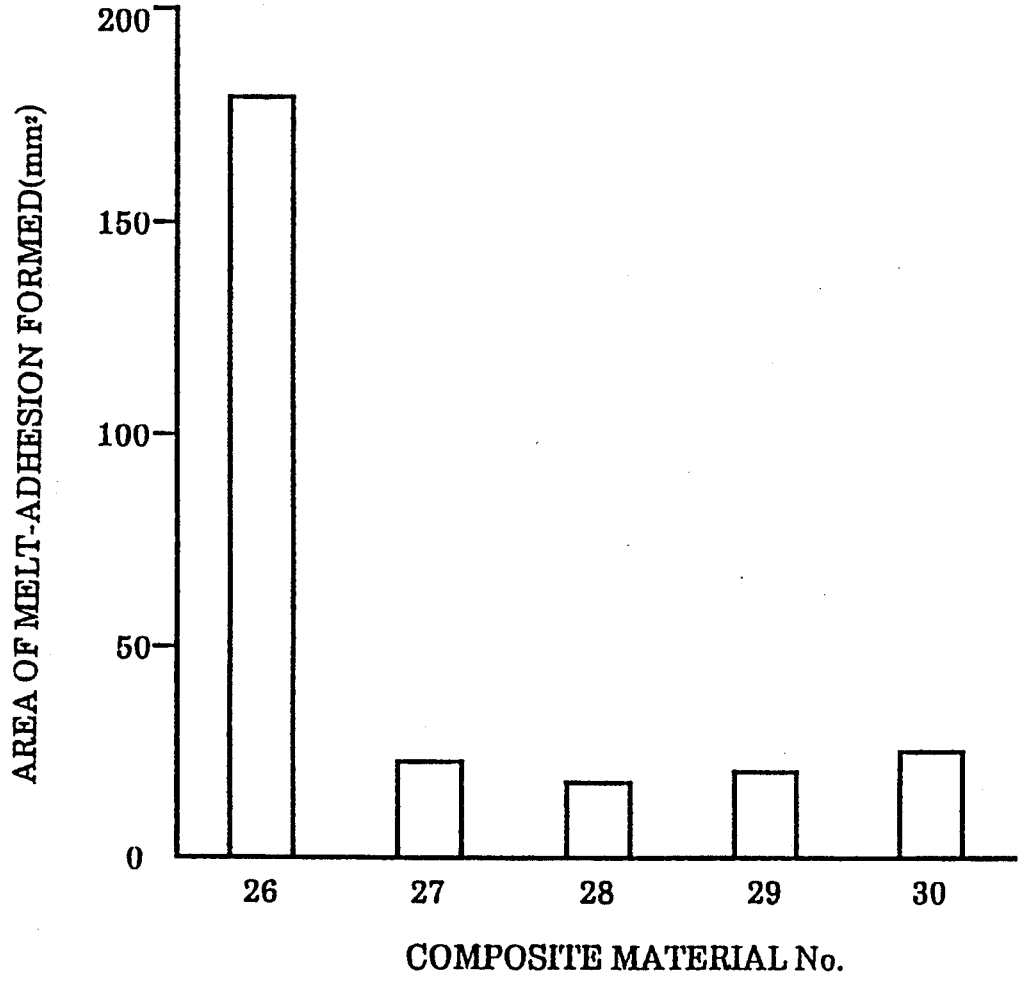
FIGS. 14 and 15 are graphs showing the results of the melt-adhesion tests, and the tension tests at 250° C. of the composite material of Example 5.
Figure 15:
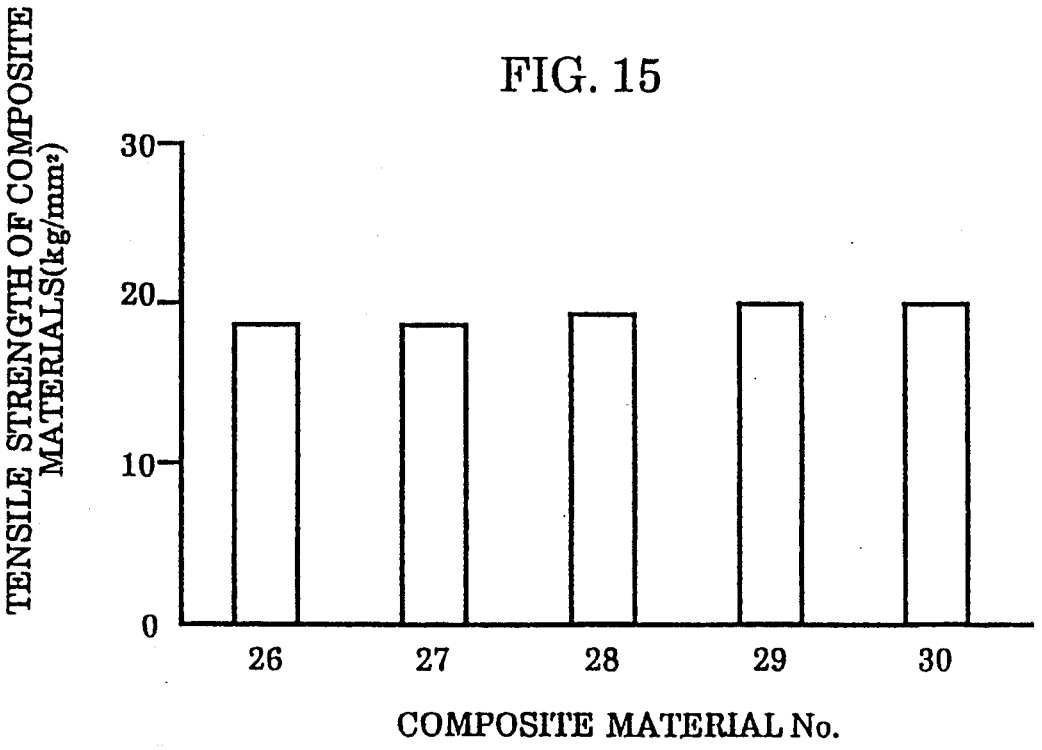

From FIG. 14, when the metal elements to form the intermetallic compounds are alloys, the anti melt-adhesion resistance of the composite materials including the finely dispersed intermetallic compounds in the matrix is more excellent than that of the prior art composite materials including no such intermetallic compounds in the matrix. From FIG. 15 it will also be understood that the tensile strength of the composite materials including such finely dispersed intermetallic compounds in the matrix is the same as or more than that of the composite material including no such intermetallic compounds in the matrix.

According to the results of these tests, the intermetallic compounds dispersed in the matrix of the composite material may be any intermetallic compounds which consist of Al and two metal elements having high melting point selected from Ni, Fe, Co, Mn, Ti, Cr, Mo, V, W, Ta, Nb, Ti, Zr, Be and Cu.

Example 6

As shown in Table 6, composite materials Nos. 31–38 were prepared according to the same method and under the same conditions, except that eight molded bodies were prepared to include 5% by volume glass fibers (25% $Al_2O_3$, 10% MgO, balance substantially $SiO_2$) of 10 microns fiber diameter on an average, 5 mm fiber length on an average) as the reinforcing material, and seven of the eight molded bodies included further 5% by volume Fe powder (purity 99%) of 200 microns, 150 microns, 100 microns, 90 microns, 60 microns, 30 microns and 5 microns particle size on an average, while one molded body for the composite material No. 31 included only 5% by volume glass fibers, and using molten aluminum alloy (JIS-AC4C: 7% Si, 0.3% Mg, balance substantially Al) at 740° C. as a molten metal.

The types, the amounts and the sizes of the intermetallic compounds in the matrix of each composite material were determined by the same method as that in Example 1. As shown in Table 6, it was found that in the composite material No. 31 no intermetallic compounds were formed in the matrix, and in the composite materials No. 37 and No. 38 formed with Fe powder of less than 30 microns particle size on an average $FeAl_3$ was formed in the matrix as finely dispersed therein, while in the composite materials Nos. 32–36 formed with Fe powder of more than 60 microns particle size on an average, although $FeAl_3$ was formed in the matrix as finely dispersed therein, there remained pure Fe in the core portion thereof. The composite materials in which such pure Fe remained were then heat treated by keeping them at 500° C. for 50 hours to completely transform remaining Fe into $FeAl_3$. It was also found that in the composite materials Nos. 32–38 the amount of $FeAl_3$ in each matrix was about 284 by volume and the average diameters were 250 microns, 200 microns, 130 microns, 120 microns, 80 microns, 40 microns and 7 microns, respectively.

After the $T_7$ heat treatment, each composite material was subjected to the melt-adhesion test at 250° C. according to the same method and under the same conditions as those in Example 1. The results of the tests are shown in FIG. 16.

Figure 16:
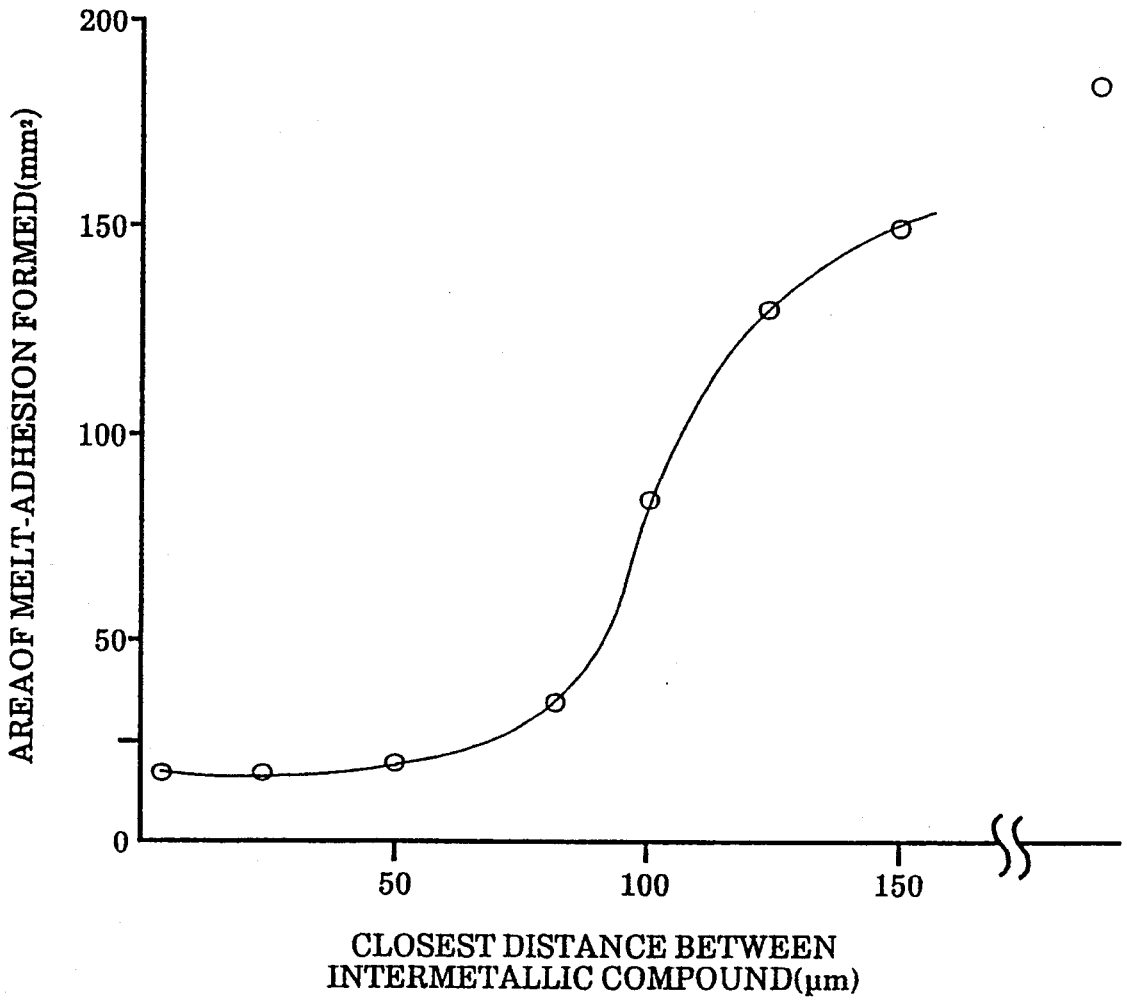
FIG. 16 is a graph showing the results of the melt-adhesion tests at 250° C. of the composite material of Example 6, wherein the abscissa indicates the closest distance between intermetallic compounds on an average.

From FIG. 16, it will be understood that as the mean closest distance between the intermetallic compounds is smaller, the composite material is improved in the melt-adhesion resistance, and if tile mean closest distance between the intermetallic compounds is less than 100 microns, particularly when it is less than 80 microns, and further particularly less than 50 microns, the area in which the melt-adhesion occurs is significantly reduced.

After the melt-adhesion tests, the state of melt-adhesion of each test piece was examined, and it was found that the melt-adhesion first occurred at a portion of Al around the intermetallic compounds, and then the melt-adhesion developed to the whole contact area of the test piece. It was also found that even when the overall volumetric amount of the intermetallic compounds is the same in two composite materials, the melt-adhesion is more liable to occur in the composite material in which the distribution of the intermetallic compounds is less uniform.

Figure 17:
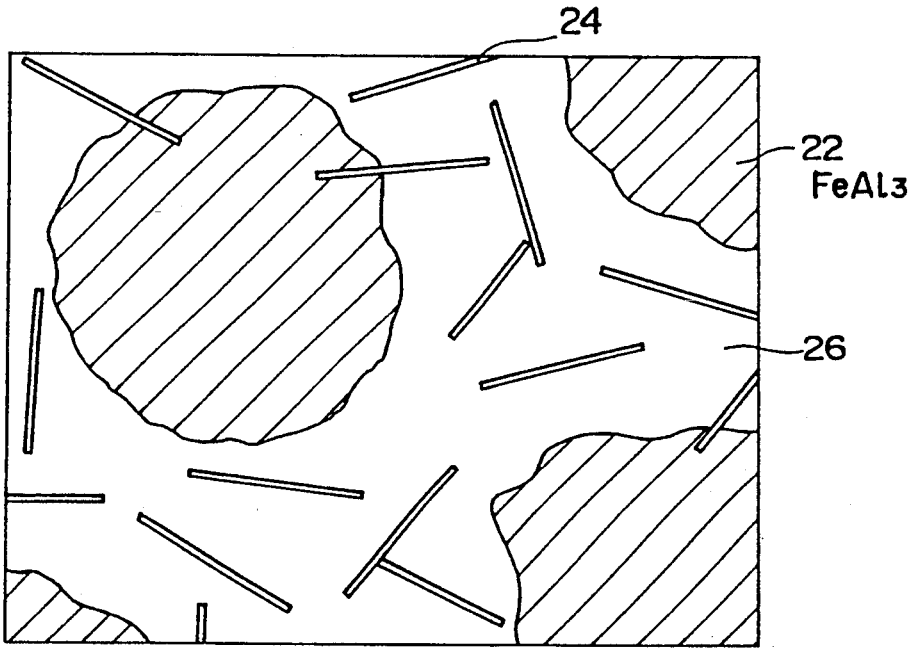
FIGS. 17 and 18 are schematic views of the composite material, wherein the particle size of the intermetallic compound $FeAl_3$ on an average are 250 microns and 40 microns, and the closest distance between the intermetallic compounds are 150 microns and 25 microns on an average, respectively.
Figure 18:
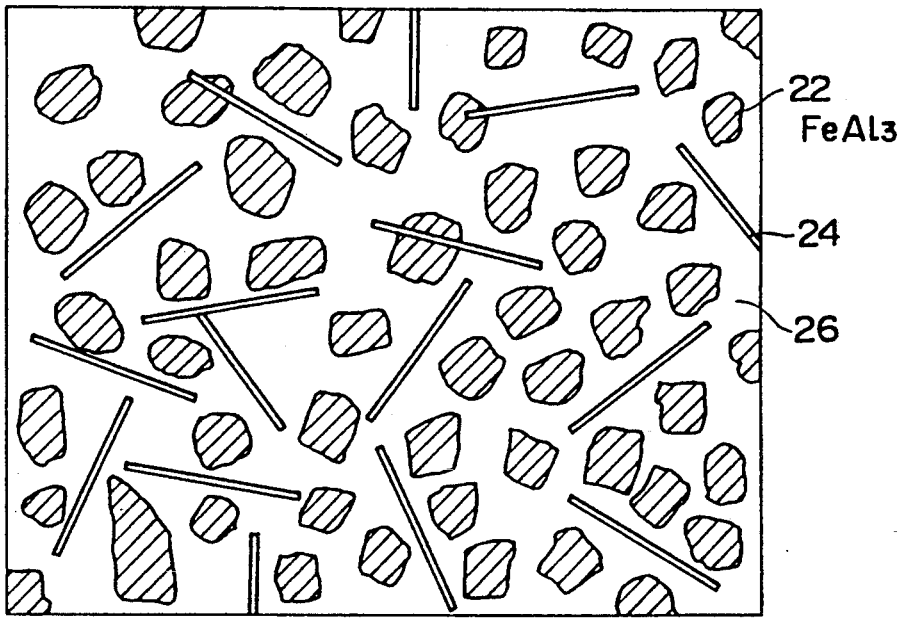
Figure 19:
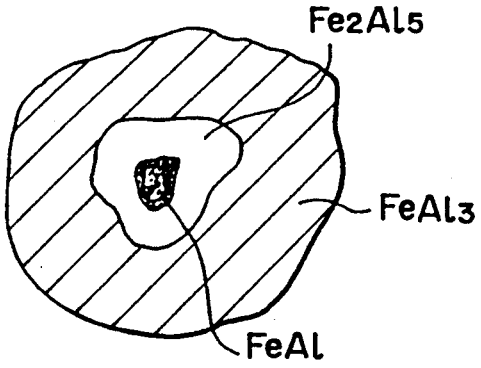
FIGS. 19 and 20 are schematic views of the cross sections of the intermetallic compounds showing their multiple layered structures.
Figure 20:
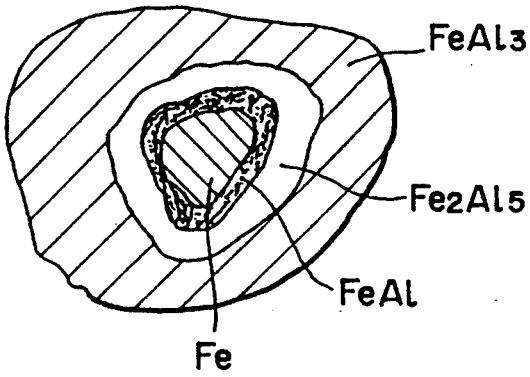

FIG. 17 is a schematic sectional view of the composite material No. 32, wherein the diameter of the intermetallic compound $FeAl_3$ is 250 microns on an average and the closest distance between the intermetallic compounds is 150 microns on an average, and FIG. 18 is a schematic sectional view of the composite material No. 36, wherein the diameter of $FeAl_3$ is 40 microns on an average and the closest distance between the intermetallic compounds is 25 microns on an average. In these drawings numerals 22, 24 and 26 indicate the intermetallic compounds $FeAl_3$, the glass fibers and the matrix, respectively. By comparison of these two drawings, it will be understood that as the intermetallic compounds have a smaller diameter, the closest distance between the intermetallic compounds is smaller and the structure of the intermetallic compounds is more uniform. In these examples, when the mean particle size of Fe powder was relatively large, pure Fe was transformed into $FeAl_3$ by heat treating at 500° C. for 50 hours, as described above, in order to accomplish a predetermined volume and a predetermined size of the intermetallic compounds (therefore a predetermined distance between the intermetallic compounds). However, it is not necessary that the intermetallic compounds should involve only a single type. For example, as far as the intermetallic compounds of the most outer layer has more excellent thermal resistance than the matrix material, the intermetallic compounds dispersed in the matrix may be such intermetallic compound that is formed in a multiple layered structure consisting of several kinds of intermetallic compounds, as shown in FIG. 19, or a multiple layered structure consisting of several kinds of intermetallic compounds and pure metal core portion, as shown in FIG. 20.

Example 7

By mixing silicon carbide whisker (98% beta-SiC) of 10–200 microns fiber length and 0.05–1.0 micron fiber diameter and Vicker's hardness 3300, and Ni powder (purity 99%) of 3 microns particle size on an average by the ratio of 2 to 1, and compressing the resulting mixture, a molded body including 10% by volume whisker and 5% by volume Ni powder was prepare to have a cylindrical form of 100 mm diameter and 20 mm height.

From this molded body a composite material No. 40 was prepare according to the same method and under the same conditions as in Example 1, except that the molded body was preheated to 300° C. in nitrogen gas atmosphere and aluminum alloy (JIS-AC8A) at 760° C. was used as the molten metal composite. According to a similar manner with, however, no Ni, a composite material No. 39 was prepared.

Further, composite materials No. 41–No. 45 were also prepared according to a similar manner by using, instead of the above Ni powder, Mg powder of 20 microns particle size on an average, Cu powder of 10 microns particle size on an average, Cr powder of 5 microns particle size on an average, Fe powder of 3 microns particle size on an average, and Ti powder of 10 microns particle size on an average, as shown in Table 7.

Then, the types, the amounts and the hardnesses of the intermetallic compounds in each matrix were determined according to the same method as those in Example 1. As shown in Table 7, in the composite material No. 39 no intermetallic compounds were formed in tile matrix, and in the composite materials No. 40–45 the intermetallic compounds of $Al_3Ni$ (and a very little amount of $Al_3Ni_2$ and AlNi), $Mg_2Al_3$, $CuAl_2$, $CrAl_7$, $FeAl_3$ and $TiAl_3$ (Vicker's hardness 950, 190, 330, 370, 550 and 740, respectively) were formed in the respective matrices at the ratio of about 30% by volume (the volumetric ratio of the intermetallic compounds in the composite material).

Further, the wear tests were carried out on these composite materials at room temperature according to the same method and under the same conditions as those in Example 1. The results of these wear tests are shown in FIG. 21, wherein the abscissa indicates the hardness of the intermetallic compounds (by Vicker's hardness).

Figures 21A, 21B:
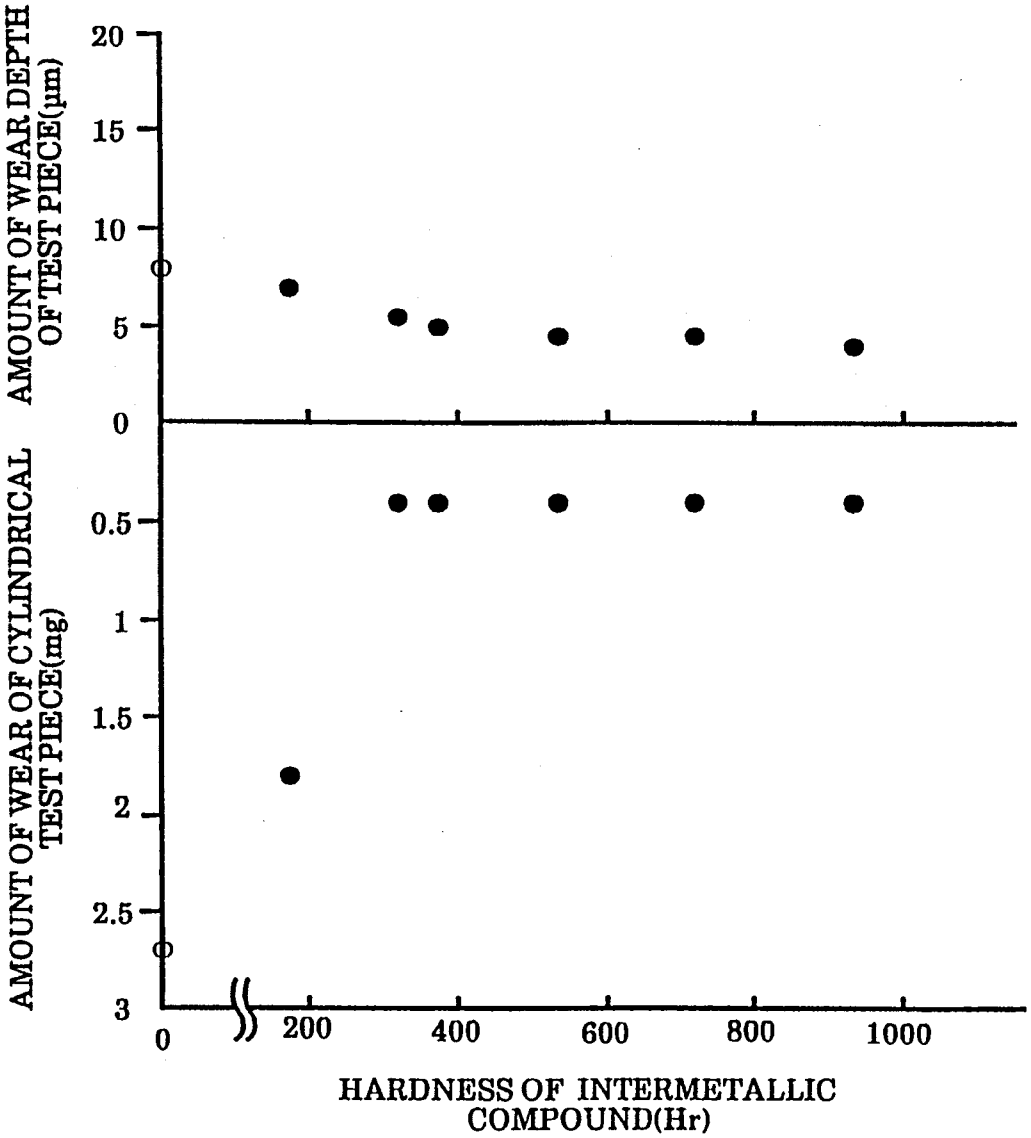
FIG. 21 is a graph showing the results of the wear tests of the composite material of Example 7, wherein the abscissa indicates the hardness of these intermetallic compounds.

From FIG. 21, it will be understood that if the hardness of the intermetallic compounds is more than 300 by Vicker's hardness, the amount of the wear of the mating members is considerably reduced, and the composite materials show more improvement in the wear resistance than the composite materials which have a hardness of less than 300 by Vicker's.

From the results of these tests, in order to improve the wear resistance of the composite material and the friction wear resistance on the mating member, the intermetallic compounds dispersed in the matrix may be any intermetallic compounds which have a hardness of more than 300 Vicker's, such as $Ni_2Al_3$, $FeAl_6$, $MnAl_6$, $ZrAl_3$, $Co_2Al_9$, $MoAl_3$, $(CuNi)_2Al_3$, $(FeSi)Al_5$, $(CuFeMn)Al_6$ or the like.

Example 8

Composite materials Nos. 46–54 were prepared by the same method and under the same conditions as those for the composite material No. 40 of Example 7, except that various kinds of fibers shown in Table 8 were used as the reinforcing fibers in the molded bodies instead of the silicon carbide whisker in the composite material 40.

For comparison, composite materials Nos. 46'–54' were prepared according to the same method and under the same conditions as those for the composite materials No. 46–54, except that the molded bodies included no Ni powder.

By using these composite materials, the wear tests were carried out at room temperature according to the same method and under the same conditions as those +in Example 1. The results of those wear tests are shown in FIG. 22, wherein the abscissa indicates Vicker's hardness of the reinforcing fibers.

Figures 22A, 22B:
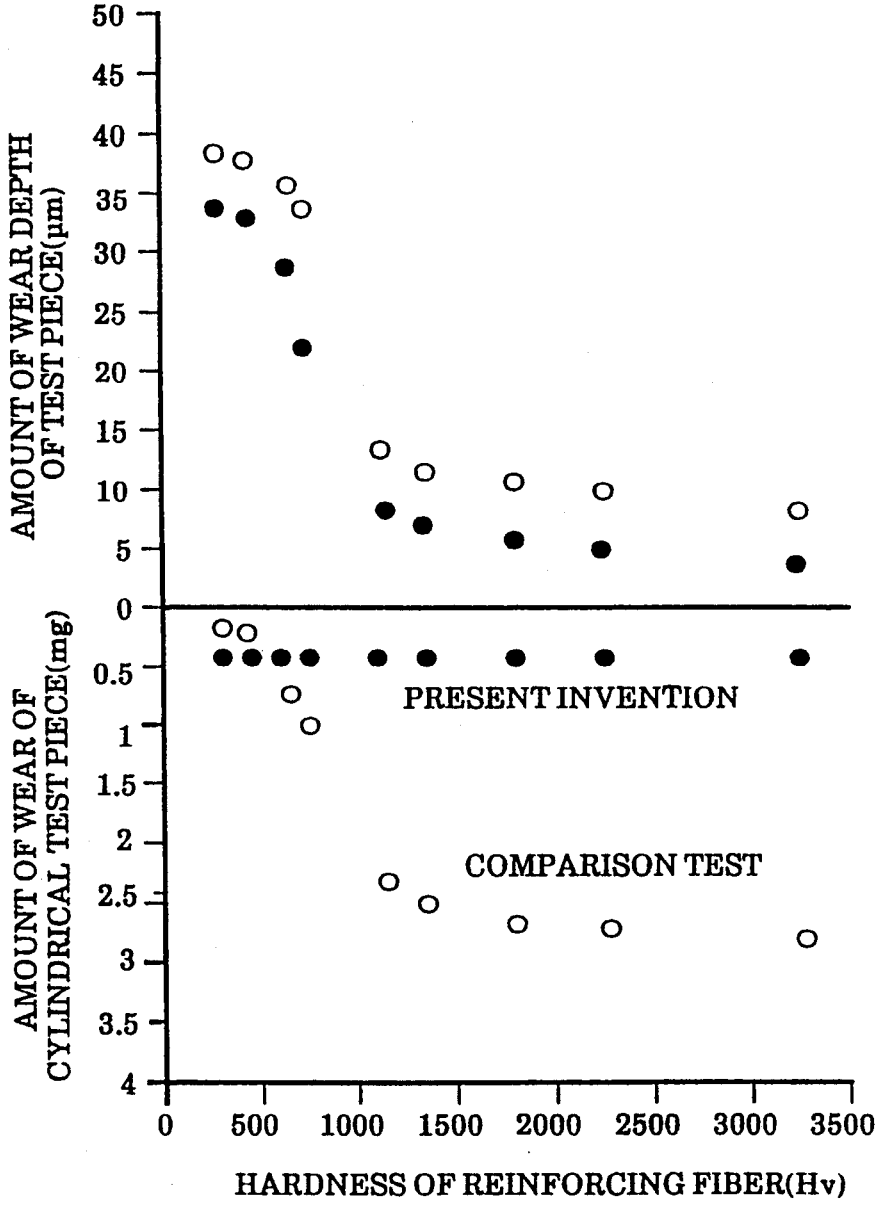
FIG. 22 is a graph of the results of the wear tests of the composite materials of Example 8, wherein the abscissa indicates the hardness of the reinforcing fibers.

From FIG. 22, it will be understood that regardless of the hardness of the reinforcing fibers, the amount of wear of the composite material itself is smaller when the intermetallic compounds are more finely dispersed in the matrix. When the reinforcing fibers are ceramic fibers having a hardness of more than 500 Vicker's hardness and commonly used to improve the wear resistance of the composite material, the composite material including such fibers with the intermetallic compounds as finely dispersed therein causes much less wearing in the mating member, and therefore exhibits more excellent characteristics to the mating member than the same ceramic fiber composite material including no such intermetallic compounds in the matrix.

Example 9

Figures 23A, 23B:
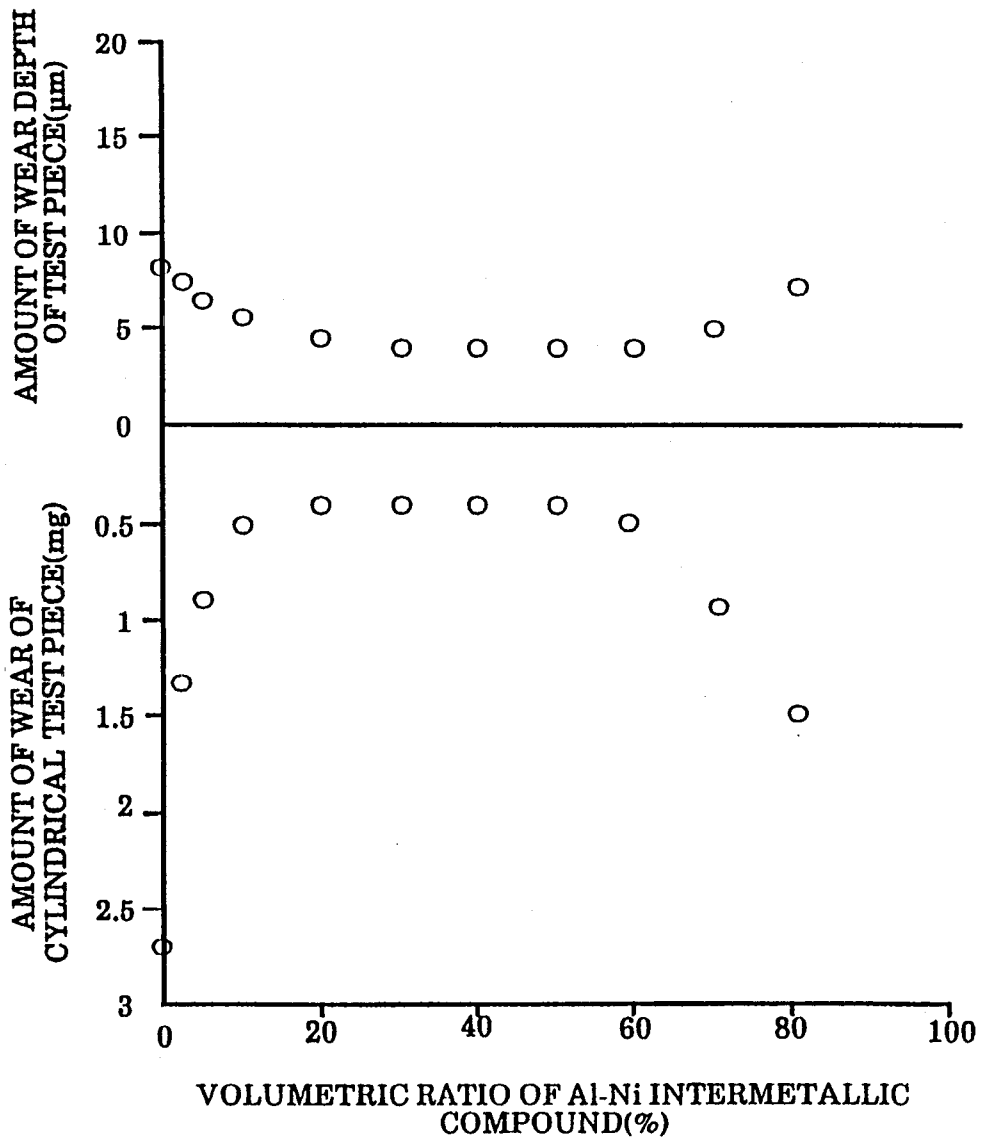
FIG. 23 is a graph showing the results of the wear tests of the composite materials of Example 9, wherein the abscissa indicates the amount of the intermetallic compounds Al-Ni by volume in the composite materials.

Composite materials Nos. 55–66 were prepared according to the same method and under the same conditions as those in Example 7, except that ten different kinds of molded bodies were prepared to include different amounts of Ni powder, and these composite materials were subjected to the wear tests at room temperature according to the same method and under the same conditions as those in Example 1. The amounts of the intermetallic compounds in the composite materials Nos. 55–64 were 34, 54, 104, 204, 404, 504, 604, 704 and 804 by volume, respectively. The results of these wear tests are shown in FIG. 23, wherein the result of the composite material No. 39 is also shown. In FIG. 23, the abscissa indicates the amount of the intermetallic compound Al-Ni by volume in the composite materials.

From FIG. 23, it will be understood that if the amount of the intermetallic compounds in the composite material is 3–80% by volume, it exhibits an improved friction wear characteristic as compared with the prior art composite material (No. 39), and therefore, the amount of the intermetallic compounds should preferably be 10–60% by volume.

When the intermetallic compounds had a hardness of more than 300 by Vicker's as in Example 7, the same results as those in FIG. 23 were obtained.

Comparison Test

Figure 24:
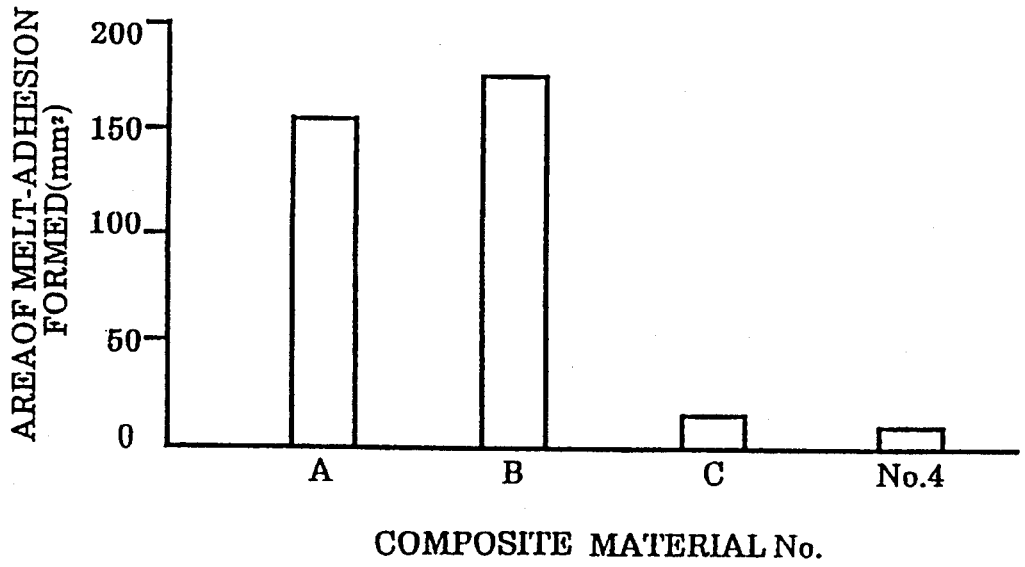
FIGS. 24 and 25 are graphs showing the results of the melt-adhesion tests at 250° C. and the wear tests at room temperature of the composite materials for comparison with the results of testing of the composite material according to the present invention.
Figure 25:
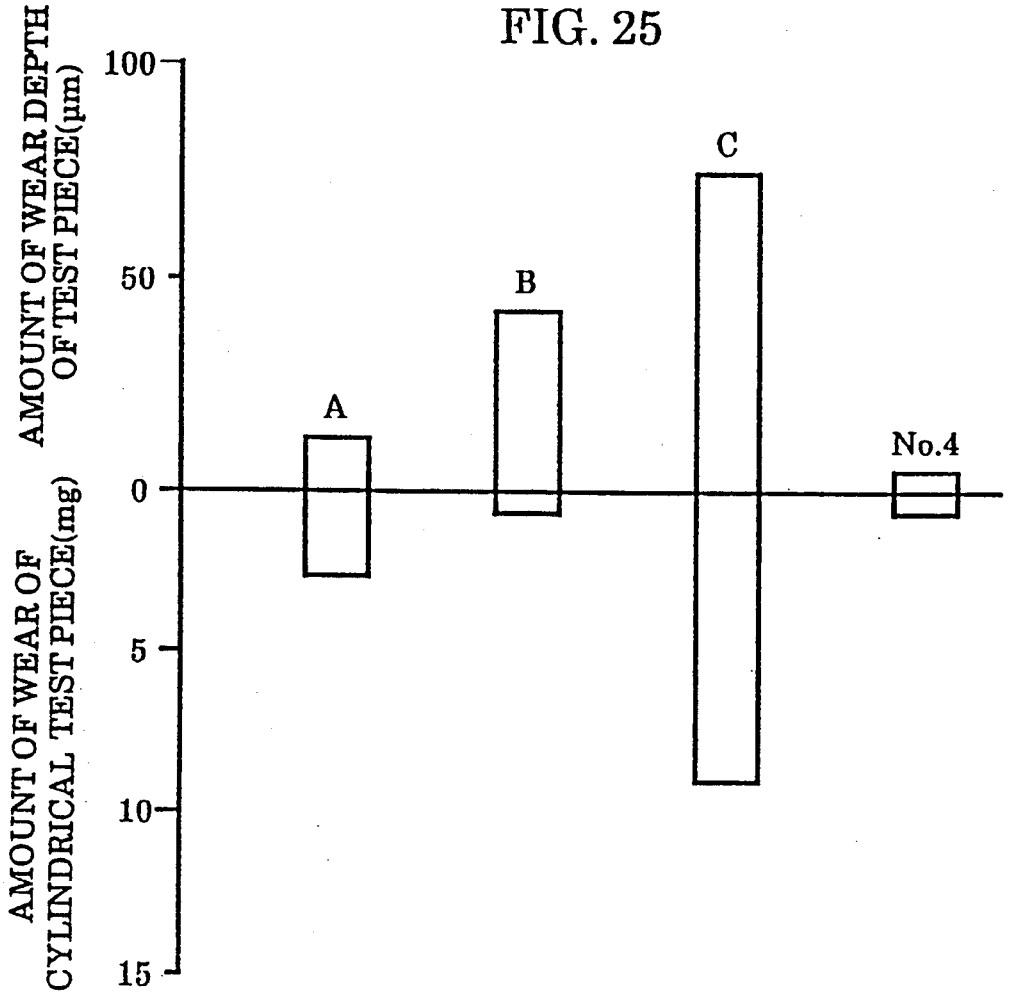

Composite materials A, B and C were prepared according to the same method and under the same conditions as those in Example 1, except that the molded bodies used were a molded body including 30% by volume the same alumina short fibers as those used Example 1 but with no Ni powder, a molded body including a three dimensional net structure (the void rate 90%, 0.3 mm cell size) consisting of Ni, and a molded body including 10% by volume the same alumina short fibers as those used in Example 1 and 8% by volume NiO powder (2 microns particle size on an average, purity 99%), respectively. The types and the amounts of the intermetallic compounds in the matrix of each composite material were determined by the same method as in Example 1. According to the results, it was observed that in the composite material A no intermetallic compounds were formed in the matrix, while in the composite material $BAl_3Ni$ (and a little amount of $Al_3Ni_2$ and AlNi) were formed around the net structures, and in the composite material C $Al_3Ni$ and $Al_2O_3$ were formed in the matrix as finely dispersed therein. It is guessed that in the composite material C the intermetallic compounds $Al_3Ni$ and $Al_2O_3$ were formed in the process of forming thereof by reduction of NiO with Al in the matrix. In the composite C the amounts of $Al_3Ni$ and $Al_2O_3$ in the matrix were 30% and 7.4% by volume, respectively. Each of the composite materials A, B and C was subjected to the melt-adhesion test at 250° C. and the wear test at room temperature according to the same method and under the same conditions as those in Example 1. The results of these tests are shown in FIG. 24 and FIG. 25, wherein the results of the composite material No. 4 is also shown. From FIG. 24, it will be understood that the melt-adhesion resistance of the composite material No. 4 is much more excellent than those of composite materials A and B, and the same as that of the composite material C. From FIG. 25 it will be understood that the composite material No. 4 according to the present invention exhibits much more excellent friction wear characteristics than the composite material C, and more excellent friction wear characteristics than the composite materials A and B.

Example 10

Figure 26:
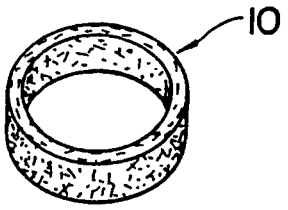
FIG. 26 is a perspective view of a cylindrically molded body made of alumina short fibers and Ni powder.

Three molded bodies 10, as shown in FIG. 26, were prepared by mixing alumina short fibers (95% $Al_2O_3$, 5% $SiO_2$, "Suffile RF" from ICI) of 2 microns mean fiber diameter and 2–3 mm mean fiber length and Ni powder (purity 99%) of 3–7 microns particle diameter by a ratio of 5.6/8.9 by weight in a colloidal silica solution, stirring the mixture completely, and then molding the mixture by a suction molding. Each of the resulting molded bodies had a cylindrical shape of 95 mm outer diameter, 89 mm inner diameter and 20 mm height. The alumina short fibers and Ni powder in the molded bodies were 10% and 5% by volume, respectively, and were substantially uniformly mixed with each other.

Figure 27:
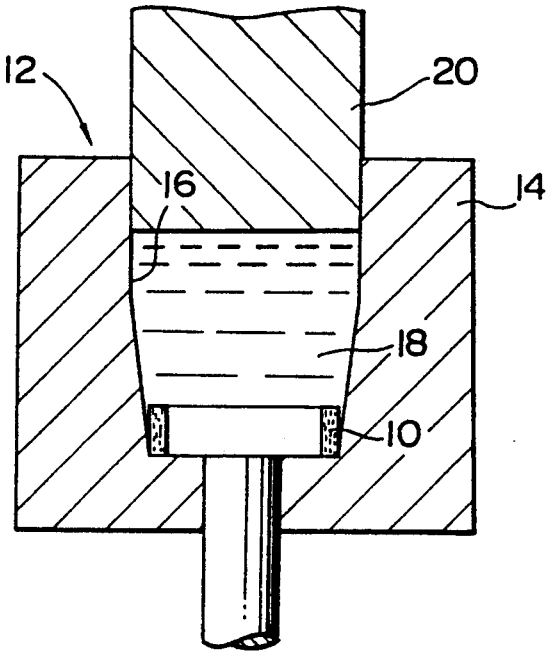
FIG. 27 is a schematic view showing a high pressure casting apparatus by which a casting is formed by using the molded body of FIG. 26.

Preheated at 400° C. in nitrogen gas, the molded bodies 10 were each fixed by pressing in a mold cavity 16 of a mold 14 of a high pressure casting apparatus 12 preheated at 400° C., and then molten aluminum alloy 18 (JIS AC8A: 12% Si, 1% Cu, 1% Mg, 1% Ni, balance substantially Al) of 750° C., 800° C. and 850° C. was poured in each mold cavity, and was pressed at 1000 kg/cm$^2$ by a plunger 20, as shown in FIG. 27, until it was completely solidified.

Figure 28:
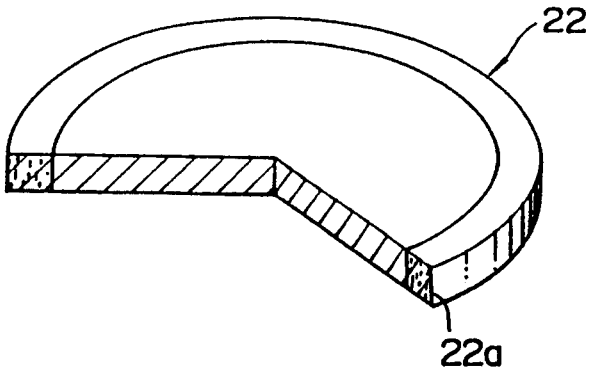
FIG. 28 is a partially cut-away perspective view of a thermal impact test piece prepared from the casting formed by the high pressure casting apparatus shown in FIG. 27.

By machining each resulting casting which was removed from the mold, each two thermal impact test pieces 22 each (test piece No. 1–3) having a disk shape of 93 mm diameter and 7 mm height were prepared, as shown in FIG. 28. The portion within 2 mm from the outer peripheral surface of each test piece was a composite material portion 22*a* reinforced with the alumina short fibers.

Figure 29:
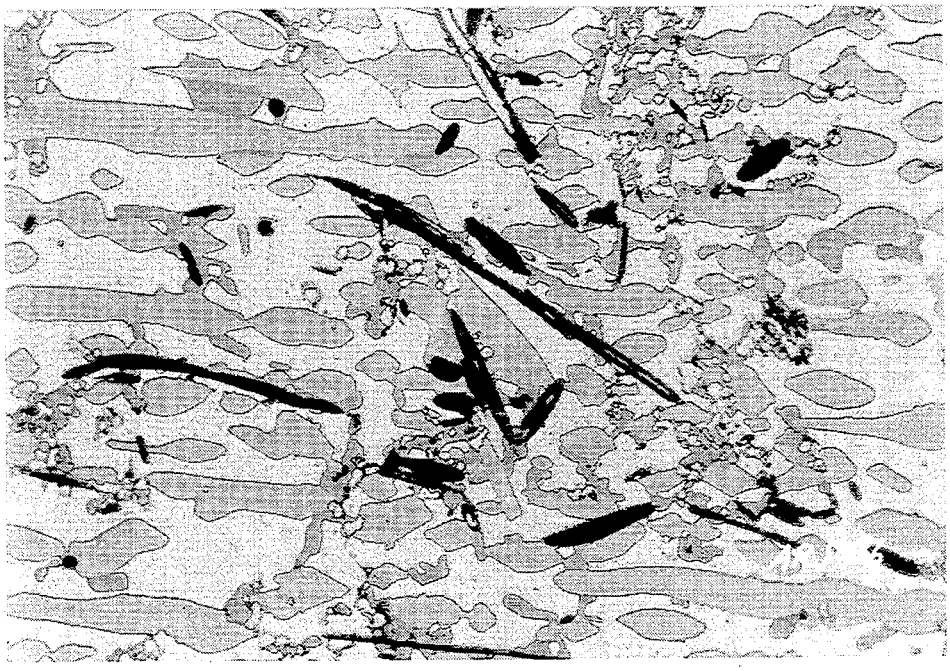
FIGS. 29–31 are microphotographs by optical microscope at 400× magnification of cross sections of the composite portions in castings formed by using molten aluminum alloy at 750° C., 800° C. and 850° C., respectively, in the high pressured casting apparatus shown in FIG. 27.
Figure 30:
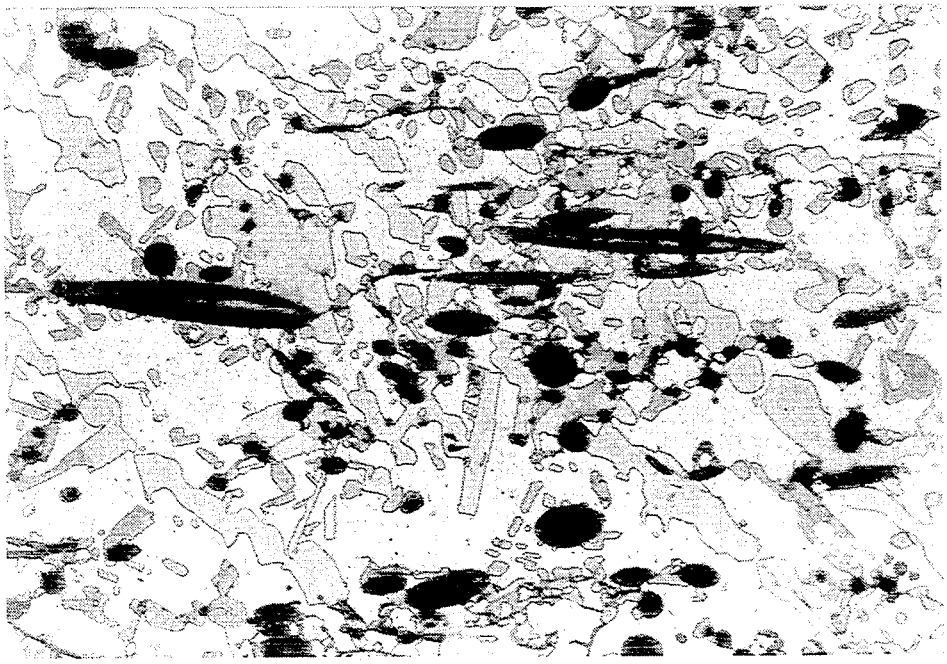
Figure 31:
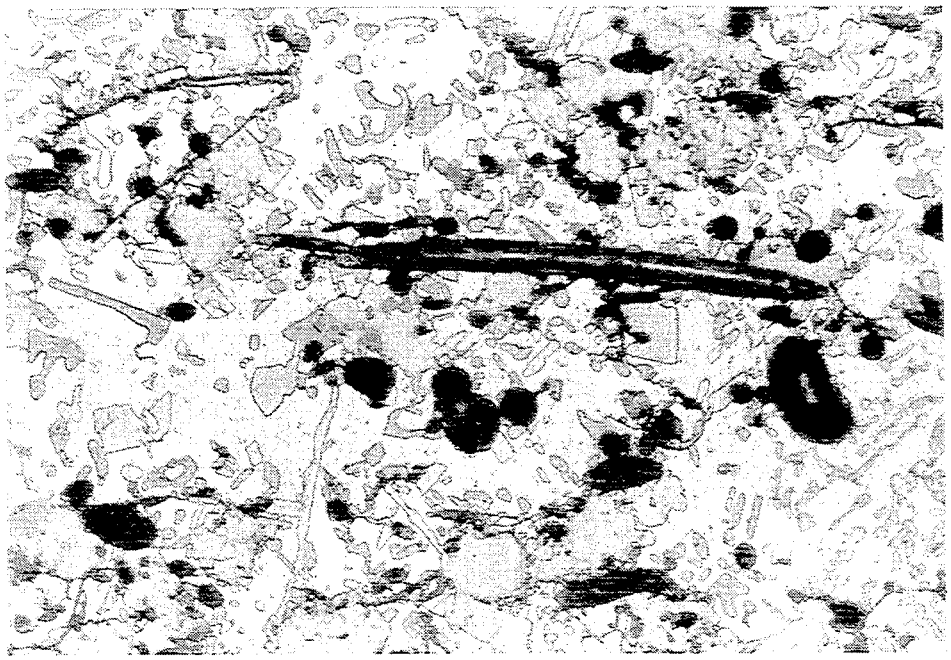

By examining the structure of the composite material portion of one of each two test pieces, it was found that an intermetallic compound $NiAl_3$ was finely dispersed in the aluminum alloy, resulting from a reaction between Ni powder of the originally molded body and Al of the aluminum alloy matrix in the high pressure casting process, and the amount of the intermetallic compounds formed in the composite material portion of each test piece was about 27% by volume. Further, by examination the intermetallic compounds in detail, it was found that the types of the intermetallic compounds varied depending on the temperature of the molten aluminum alloy in the high pressure casting process. FIGS. 29–31 are microphotographs at 400× magnification showing the structures in the cross section of the composite material portion of test pieces No. 1–3 which were respectively formed by the molten aluminum alloy of 750° C., 800° C. and 850° C. In these microphotographs, white or gray island-shaped portions or particle-shaped portions are Ni-Al intermetallic compounds, and black stick-shaped portions or round portions are alumina short fibers.

From FIGS. 29–31, it will be understood that the types or shapes of the intermetallic compounds depend on the temperature of the molten matrix metal, and as the molten matrix metal is heated at higher temperature, the shape of the intermetallic compounds varies from a particle shape to a needle shape. It was also confirmed that in addition to the temperature of the molten matrix metal, the shape of the intermetallic compounds depends on the temperature of the mold and the preheating temperature of the molded body.

Figure 32:
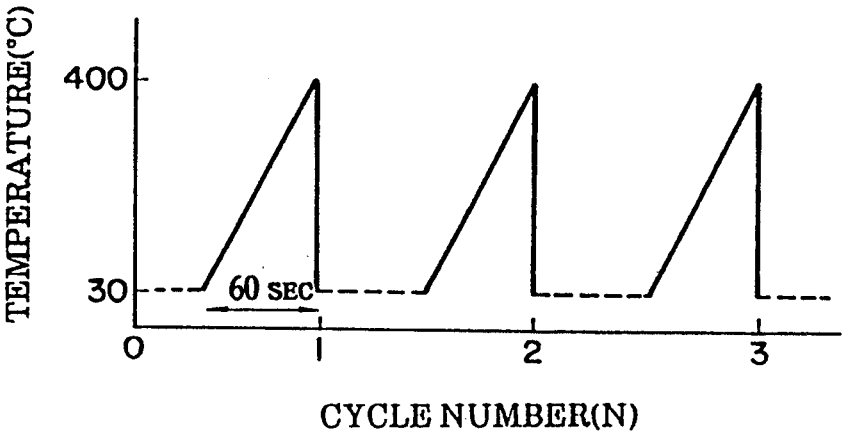
FIG. 32 is a graph showing the thermal cycle of a thermal impact test.

By using the other of each two test pieces No. 1–3, thermal impact tests of 500 cycle were carried, each cycle involving heating each test piece to 400° C. by an acetylene gas burner and then quenching it in water, as shown in FIG. 32. The results are shown in FIG. 33.

Figure 33:
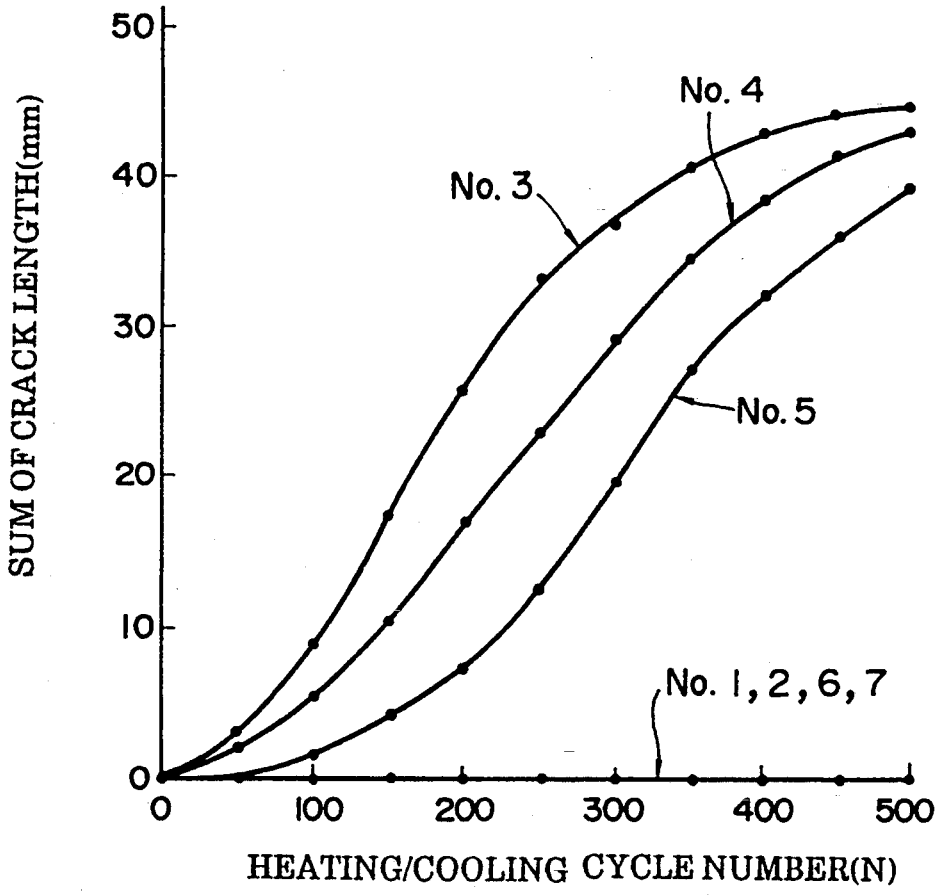
FIG. 33 is a graph showing the results of the thermal impact tests, wherein the abscissa indicates the number of the thermal cycles.

From FIG. 33 it will be understood that no cracks were formed in test piece No. 1 and No. 2, while in test piece No. 3 cracks were formed at 50th cycle of the thermal cycle, and these cracks developed as the number of the thermal cycle increased.

From the results of the thermal impact test, it will be understood that even if substantially the same amount of the intermetallic compounds are finely dispersed in the matrix of the composite material, the thermal impact characteristic varies significantly depending on the types or shapes of the intermetallic compounds, and if the intermetallic compounds are in a particle shape, it exhibits an excellent thermal impact resistance, while if the intermetallic compounds are in a needle shape, it has insufficient thermal impact resistance. In test piece No. 2 corresponding to FIG. 30 including both the particle shaped and the needle shaped intermetallic compounds in the composite portion, no cracks were formed, and it is therefore understood that the composite material may include needle shaped intermetallic compounds as far as the ratio thereof is controlled under a desired value.

Example 11

Since it was found that it is important to establish the ratio of needle shaped intermetallic compounds in the matrix of the composite material, as described in Example 10, thermal impact tests were carried out to know in what manner the ratio of needle-shaped intermetallic compounds affects the thermal impact characteristic of the composite material.

After molded bodies were prepared, and castings were formed and subjected to the thermal impact tests according to the same method and under the same conditions as those of Example 10, except that the molten aluminum alloy (JIS AC8A) for the matrix was heated in the high pressure casting process at 840° C., 830° C., 820° C. or 810° C.

By optical microphotographic observations of ten visual fields on each cross section of the surface portion of the composite material portion of test pieces No. 1–3 prepared in Example 10 and test pieces No. 4–7 prepared in this second example, the amounts of needle shaped intermetallic compounds $NiAl_3$ having a L/D ratio (L and D are length and width of each needle shaped intermetallic compound element) greater than 3 were measured by area in the cross sections. The results are shown in Table 11.

From Table 11, it will be understood that as the temperature of the molten aluminum alloy is lower, the ratio of needle formed Ni-Al intermetallic compounds produced in the matrix of the composite portion is reduced.

Thermal impact tests were carried out by using test pieces No. 4–7 of this second example according to the same method and under the same conditions as in Example 10. The results are also shown in FIG. 33.

From FIG. 33, it will be understood that if the area ratio of the needle shaped intermetallic compounds having a L/D greater than 3 exceeds 30%, the thermal impact characteristic of the composite portion deteriorate, and therefore, in order to improve the thermal impact resistance of the composite material the amount of needle shaped intermetallic compounds should preferably be less than 30% by area in a cross section thereof.

Example 12

After molded bodies were formed by the same method and under the same conditions as Example 10, except that Ti powder of 10 microns particle size on an average, Cr powder of 3 microns particle size on an average, Fe powder of 3 microns particle size on an average, Cu powder of 10 microns particle size on an average, and Ta powder of 5 microns particle size on an average were used instead of Ni powder in Example 10, and castings were prepared from the respective molded bodies and the molten aluminum alloy which was heated to various temperatures by the same method and under the same conditions as those in Example 11, so that each two thermal impact test pieces were formed from each casting.

Figure 34:
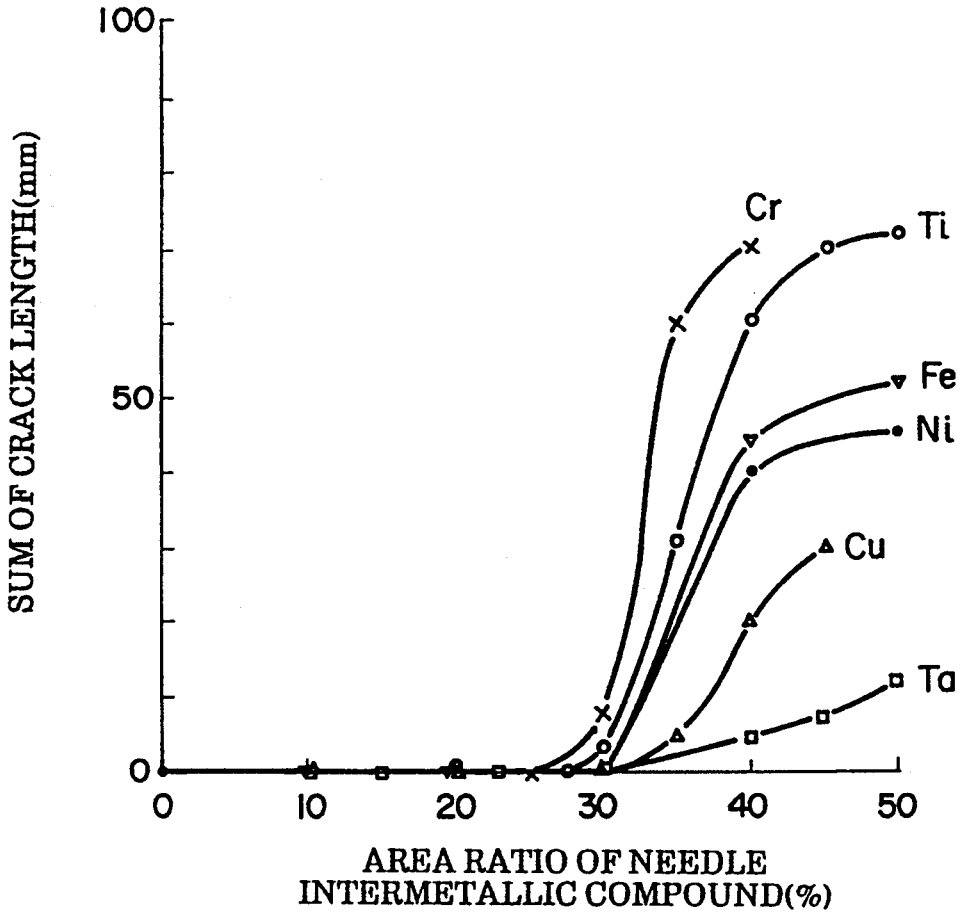
FIG. 34 is a graph showing the results of the thermal impact tests, wherein the abscissa indicates the amount of needle shaped intermetallic compounds by area having a ratio L/D greater than 3.

By examining one of each two test pieces in order to determine the types of the intermetallic compounds by the same method as that in Example 10, it was found that $TiAl_3$, $CrAl_7$, $FeAl_3$, $CuAl_2$ or $TaAl_3$ was finely dispersed in the aluminum alloy matrix. The amount of needle shaped intermetallic compounds having a L/D ratio greater than 3 in a surface portion of the composite material portion of each test piece was measured by area occupied thereby, and thermal impact tests were carried out by using the other of each two test pieces according to the same method and under the same conditions as those in Example 10. The results are shown in FIG. 34. In FIG. 34 each element indicates the metal element of the powder used to form the intermetallic compounds.

From FIG. 34, it will be understood that regardless of the types of the intermetallic compounds formed in the matrix of the composite portions, if the amount of needle shaped intermetallic compounds having a L/D ratio greater than 3 is less than 30% by area, the thermal impact resistance of the composite material can be improved.

Example 13

Cylindrically molded bodies having 95 mm outer diameter, 73 mm inner diameter and 20 mm height were formed by a suction molding method as described in Example 10. Alumina short fibers and Ni powder used in this example were the same as those used in Example 10, and were used in the same volumetric ratio as in Example 10.

Preheated at 400° C. in nitrogen gas, each molded body was placed in a mold cavity of a high pressure casting apparatus, a molten aluminum alloy (JIS AC8A) at 850° C. was poured into the mold cavity, high pressured casting was carried out according to the same method and under the same conditions as those in Example 10. In the casting process, the temperature of the mold was 400° C., 350° C., 300° C., 250° C., 200° C., 150° C. or 100° C.

After removed from the mold, the resulting castings were machined to form thermal impact test pieces No. 8–14 having the same dimensions and the same shape as those in Example 10. The peripheral portion within 10 mm from the outer peripheral surface of each test piece was composed of a composite material reinforced with alumina short fibers.

Each test piece was then examined in a cross section of the composite portion thereof, and it was found that the types of Ni-Al intermetallic compounds produced in the composite portion varied depending on the temperature of the mold in the casting process. The relation between the temperature of the mold and the width of the structure in which the amount of needle shaped intermetallic compounds having a ratio L/D greater than 3 was less than 30% by area (hereinafter referred to as "X structure") formed in the matrix of a surface portion of the composite material portion of each test piece is shown in Table 12.

From Table 12, it will be understood that if the temperature of the mold is 400° C., the width of X structure is zero, while if the temperature of the mold is lower than 350° C., the width of X structure increase as the temperature of the mold is lowered.

By using these test pieces No. 8–14, thermal impact tests were carried out according to the same method and under the same conditions as those in Example 10. The results are shown in FIG. 35.

Figure 35:
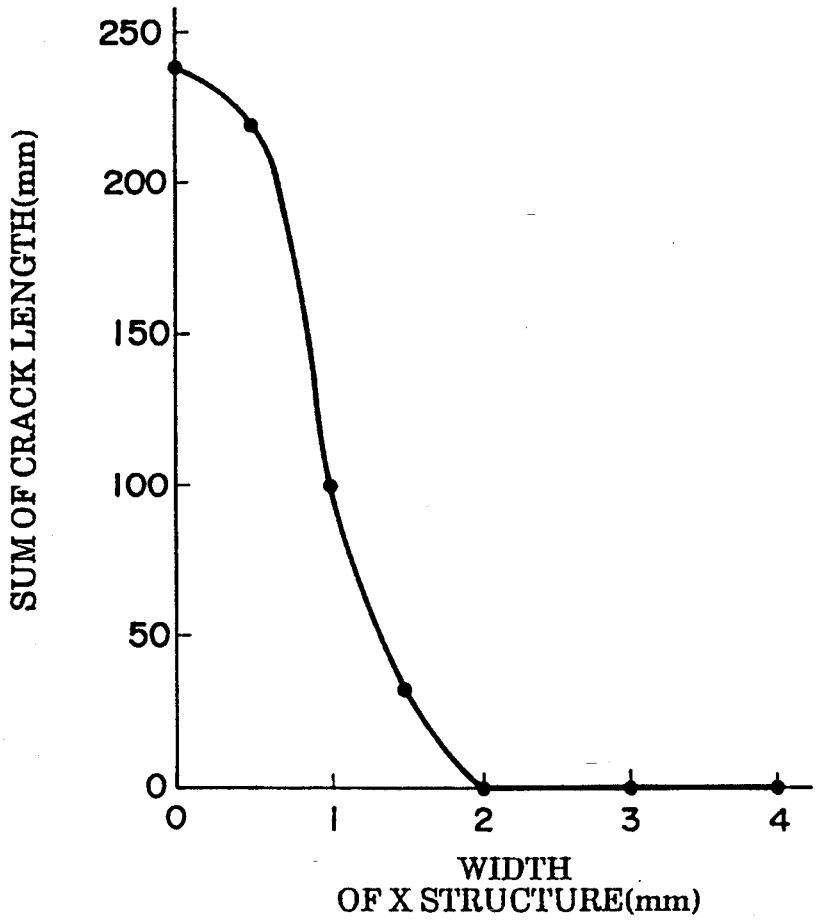
FIG. 35 is a graph showing the results of the thermal impact tests, wherein the abscissa indicates the width of the structure in which the amount of needle shaped intermetallic compounds having a ratio L/D greater than 3 is 30% by area.

From FIG. 35 it will be understood that in order to improve the thermal impact characteristic of the composite material portion, the width of X structure in the surface portion of the composite material portion should be more than 1 mm, more preferably more than 1.5 mm.

As will be understood from the results of Examples 2 and 3, as the amount of the needle shaped intermetallic compounds by area is less, the thermal impact resistance of the composite material can be more improved, and therefore, when the amount of the needle shaped intermetallic compounds having a ratio L/D greater than 3 is less than 30% by area, and the width of the X structure is in the above-mentioned range, an excellent thermal impact resistance of the composite can be accomplished.

Example 14

Molded bodies of such types and weight ratio of fibers and powder as shown in Table 13 were formed, and castings were prepared from these molded bodies to be subjected to the thermal impact tests according to the same method and under the same conditions as those in Example 13. In Table 13, the amount of fibers and powder in each molded body were 10% and 5% by volume, respectively, and each powder had a particle size of more than 10 microns and purity of more than 99%. When stainless steel short fibers or cast iron short fibers were used, molded bodies were formed by a compression molding method.

In these test pieces of this example, if the width of X structure was more than 1 mm, particularly more than 1.5 mm, the composite portion of the casting exhibited an excellent thermal impact resistance.

It was also found, though not shown in this example, that when Nb powder, Ta powder, Cu powder or W powder was included in the molded body, the width of X structure should preferably be more than 1 mm, more preferably more than 1.5 mm.

Although the castings in the above examples were a in disk shape, they may be in any shape other than disc, and the surface layer in which the amount of intermetallic compounds having a ratio L/D greater than 3 is less than 30% by area may be formed in any desired portion or in the whole surface area of the casting.

Example 15

Figure 36:
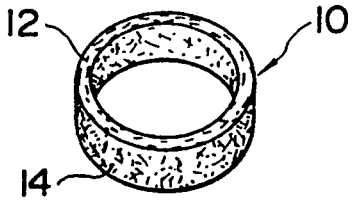
FIG. 36 is a perspective view of a cylindrically molded body including alumina short fibers and Ni powder.

Four cylindrical molded bodies 10 having 90 mm outer diameter, 70 mm inner diameter and 20 mm height, as shown in FIG. 36, were prepared by stirring uniformly a mixture of alumina short fibers (95% $Al_2O_3$, 5% $SiO_2$, "SUFFIL RF" from ICI) of 2.8 microns mean fiber diameter and 2–3 mm length and Ni powder (purity 99%) of 5 microns mean particle size in water and then molding the mixture by suction molding. In the molded bodies thus obtained, the amount of alumina short fibers was 7% by volume and the amount of Ni powder was 5% by volume, and the alumina short fibers 12 and Ni the powder particles 14 were substantially uniformly mixed with each other, with the alumina short fibers oriented at random in two dimensions along the cylindrical surface of the molded body.

Figure 37:
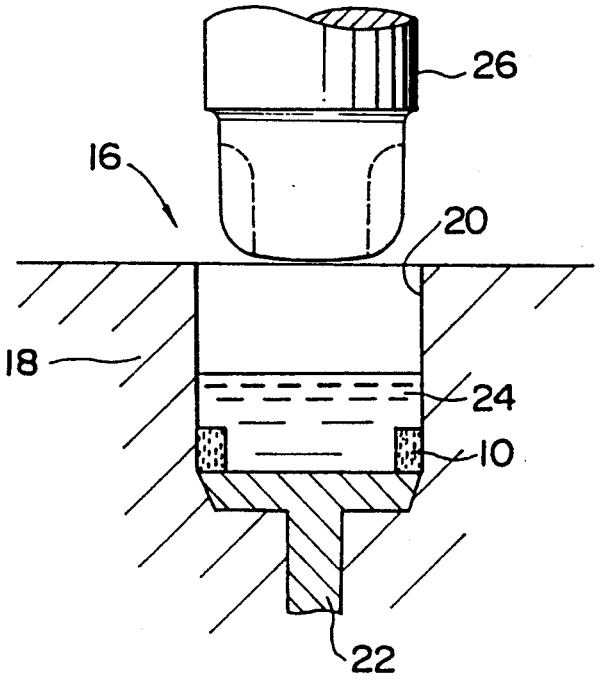
FIG. 37 is a schematic view showing the manner of preparing piston preforms by using the molded body shown in FIG. 36 according to a high pressure molding.

Each molded body was then preheated to about 300° C. for 20 minutes, and then was placed, as shown in FIG. 37, on a knockout plunger 22 in a mold cavity 20 along the inner surface thereof of a mold 18 of a high pressure casting apparatus 16 for casting pistons, and a molten metal 24 of aluminum alloy (JIS AC8A) was poured into the mold cavity at 780° C. Thereafter, the molten alloy was pressed at 1000 kg/cm$^2$ by inserting and pressing the plunger 26 fitted into the mold cavity and was kept in this condition until the molten metal was fully solidified, so as to produce the four molded bodies. These molded bodies were then subjected to heat treatment $T_7$, i.e. heating at 490° C. for 4 hours, then cooled by water, then heated again at 220° C. for 6 hours, and then cooled in the furnace.

One of the piston preforms thus prepared was cut for inspection of the structure of the composite material, and by the inspection it was found that the alumina short fibers were dispersed in the aluminum alloy (JIS AC8A) and intermetallic compound $Al_3Ni$ was formed by the reaction between Ni powder and Al in the aluminum alloy, with the resulting product being diffused in finely dispersed manner in the area among the alumina short fibers. The amount of intermetallic compound $Al_3Ni$ was about 27% by volume. It was also revealed that the original structure of the aluminum alloy (JIS AC8A) remained in the portion except the the portion compositely reinforced by the molded body.

Wear Test

Wear test pieces having dimensions 10×15×6 mm were prepared for friction wear tests from the composite material portion of the piston preform. These test pieces were cut out to so that the test surface of 15×6 mm was perpendicular to the long axis of the cylindrical molded body.

Figure 38:
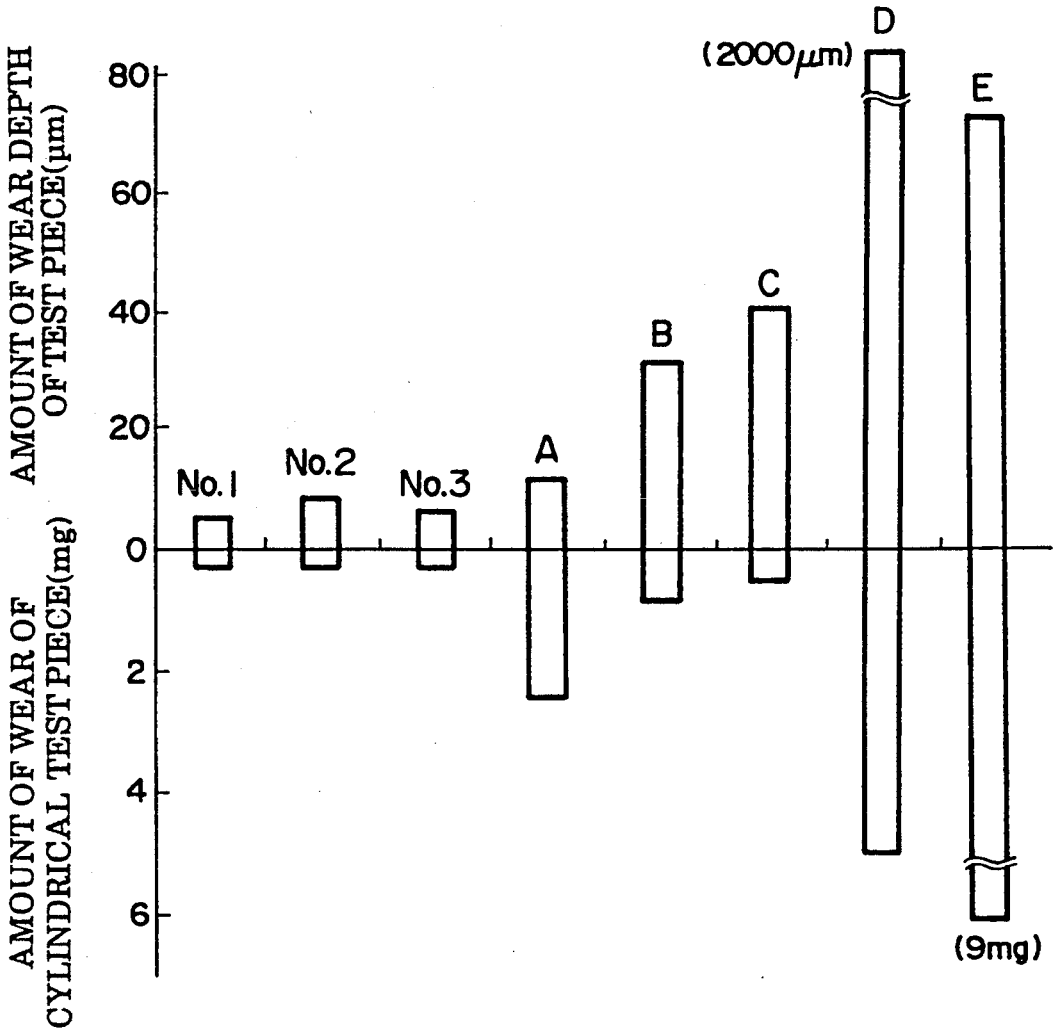
FIG. 38 is a graph showing the results of the wear tests conducted with respect to the composite materials of Example 15, Example 16 and example for comparison.

The wear test involved bringing each of the test pieces into contact with the outer surface of a cylindrical test piece having 35 mm outer diameter, 30 mm inner diameter and 10 mm length made of a stainless steel (JIS SUS440B), softly nitrided by nitrogen gas, at room temperature, and rotating this cylindrical test piece for one hour at a sliding speed of 0.3 m/sec with the test piece being pressed in contact thereto at a contact pressure of 60 kg/mm$^2$ under supply of lubricating oil (SAE 10W—30) at room temperature to the contact portions. The results are shown in FIG. 38 by No. 1. In FIG. 38, the upper half of the graph shows the amounts of wear depth (microns) of the wear test pieces, while the lower half of the graph shows the amounts of wear (mg) of the mating cylindrical test pieces.

It will be understood from FIG. 38 that the wear depth in the wear test piece was about 6 microns on an average and the wear in the cylindrical test piece was about 0.4 mg on an average, and therefore the composite material formed in the reinforced portion of the above-mentioned piston preform had an excellent friction wear resistance at room temperature.

Manufacturing Pistons

Figure 39:
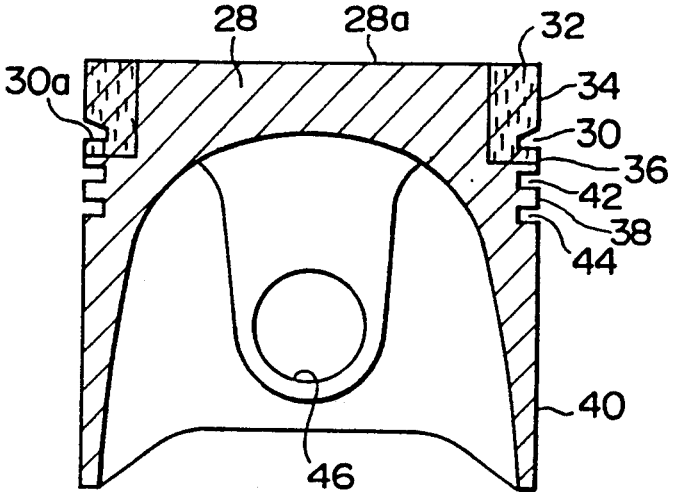
FIG. 39 is a sectional view of an embodiment of the piston according to the present invention.

Pistons having 85 mm diameter and 75 mm height, as shown in FIG. 39, were manufactured by machining the above-mentioned piston preforms, in which only a portion within 17 mm from the flat end surface 28*a* of a head portion 28 and 7.5 mm from the cylindrical outer surface including a top ring groove 30 was made of the composite material 32 which included the finely dispersed intermetallic compounds in the matrix compositely reinforced with the alumina short fibers. In FIG. 39, a top land, a second land, a third land and a skirt portion are indicated by 34, 36, 38 and 40, respectively, and a second ring groove, an oil ring groove and a piston pin bore are indicated by 42, 44 and 46, respectively. Three different pistons (1)–(3) having the distances from the end surface 28 to the lower surface 30*a* of the top ring groove of 15 mm, 12 mm, and 8 mm, respectively, were prepared in order to expose the lower surface 30*a* of the top ring groove to various thermal conditions. These pistons (1)–(3) were then incorporated in a 2000 cc diesel engine with four cylinders and turbocharger and were subjected to a durability test of 300 hours continuous operation at full load under the predetermined conditions as shown below, and after the completion of the test maximum wear depths in the lower surface of the top ring groove and in the lower surface of the top ring were measured:

Rotation speed: 4500 rpm
Cooling water temperature: 105±5° C.
Oil temperature: 125±5° C.
Exhaust gas temperature: 850° C.
Output/Torque: 106 PS/26.4 kgm The results of the measurements are shown as composite materials No. 1 in Table 14. The top rings used in these tests were prepared by a stainless steel (JIS SUS440B) softly nitrided by nitrogen gas.

Table 14 shows that the amounts of wear in the lower surface of the top ring groove and in the lower surface of the top ring were constant and small regardless of the position of the top ring groove and no unusual wear such as melt-adhesion occurred, and therefore it is understood that the piston in which the lower surface of the top ring groove was defined by the composite material No. 1 of this example exhibited an excellent wear resistance and melt-adhesion resistance at high temperature.

Example 16

Four piston preforms including composite material No. 2 and another four piston preforms including composite material No. 3 were prepared from the same materials and according to the same method as those in the Example 15, except that Co powder (purity 99%) of 12 micron mean particle size and Fe powder (purity 99%) of 10 microns mean particle size were used instead of the Ni powder. The amounts of Co powder and Fe powder in the molded bodies were 4% and 5% by volume, respectively.

The structure in a cross section of each piston preform was inspected and found that 30% by volume intermetallic compound, $Al_9Co_2$, was finely dispersed in the matrix of the composite material No.2, while 28% by volume intermetallic compound, $Al_3Fe$, was finely dispersed in the matrix of the composite material No. 3.

Wear test pieces were prepared by cutting out from each of the composite materials according to the same manner as in Example 15, and each test piece was subjected to the wear test at room temperature under the same conditions and according to the same method as those in Example 15. The results of these wear tests are shown in FIG. 38 as No. 2 and No. 3, respectively. It is understood from FIG. 38 that these composite materials No. 2 and No. 3 exhibited significantly high friction wear resistance like the composite material No. 1.

Three pistons 1–3 which had the same dimensions as those in Example 15 were prepared from the above piston preforms according to the same manner as in the Example 15, and each piston was subjected to the durability test under the same conditions and according to the same method as in the Example 15. The results of these tests are also shown in Table 14 as No. 2 and No. 3, respectively.

Table 14 shows that the amounts of wear in the lower surface of the top ring were also small in the composite materials No. 2 and No. 3, and it is therefore understood that these pistons exhibited improved wear resistance and melt-adhesion resistance at high temperature like those of Example 15.

Comparison Test

Piston preforms A–C and E were prepared according to the same method and under the same conditions as those in Example 15, using a molded body A, which had the same dimensions as a molded body 10 of the above-mentioned Example 15, including only 7% by volume alumina short fibers with no Ni powder, a molded body B which was prepared by compression molding of cast iron short fibers (JIS FC23) of 20 microns mean fiber diameter and 3 mm mean length to be 20% by volume, a molded body C which was prepared by processing a three dimensional net structure (90% void ratio, about 1 mm cell size ) of nickel to be 10% by volume, and a molded body E including about 8% by volume NiO powder (2 microns mean particle size, purity 99%) and 7% by volume alumina short fibers.

By inspecting the structure in a cross section of each piston preform made of the molded bodies A–C and E, it was found that in composite material A made from the molded body A no intermetallic compounds were present in the matrix, while in composite material B made from the molded body B intermetallic compound $Al_3Fe$ was generated around the cast iron fibers, and in composite material C made from the molded body C intermetallic compound $Al_3Ni$ was generated around the net structures. It was also revealed that in composite material E made from the molded body E about 27% by volume intermetallic compound $Al_3Ni$ and about 7% by volume intermetallic compound $Al_2O_3$ were generated by the reaction between Al of matrix and NiO powder, and the particle size of these intermetallic compounds were about 100–150 microns.

Wear test pieces A–C and E were then prepared by cutting out from these composite materials and a wear test piece D was prepared by cutting out from the matrix portion consisting of only aluminum alloy (JIS ACBA), and these test pieces were subjected to the wear test at room temperature according to the same method and under the same conditions as those in Example 15. The results of these wear tests are shown in FIG. 38.

In FIG. 38, it will be understood that the composite materials A–C had much better friction wear resistance than the material D which includes only the aluminum alloy for the matrix, but the composite materials No. 1–3 of Examples 1 and 2 exhibited much more excellent friction wear resistance than those composite materials for the comparison. In using the composite material E, a relatively large amount of wear was caused in the wear test piece and also in the cylindrical test piece, and it is therefore understood that the composite material E is not suitable for defining the lower surface of the top ring groove. It is guessed that when the wear test piece moved in contact with the surface of the cylindrical test piece, $Al_2O_3$ particles were removed from the matrix, thereby increasing the wear in the contacting surfaces by the removed particles. Further, when the composite material E is used, it will be necessary to lower the contend of NiO powder in a molded body in order to maintain the wear resistance at an appropriate level, because the yield ratio between the intermetallic compound $Al_3Ni$ and the oxide $Al_2O_3$ is always constant in relation of the reactions. It was also found, though not shown in the results of the experiments, that if the amount of $Al_3Ni$ was less than 1% by volume, a relatively good wear resistance was accomplished. In this case, however, it was revealed that the intermetallic compound $Al_3Ni$ decreases to be less than 4% by volume and a melt-adhesive wear might easily occur in the piston in which the lower surface of the top ring groove was defined by such a composite material.

Measurement of Temperature

Figure 40:
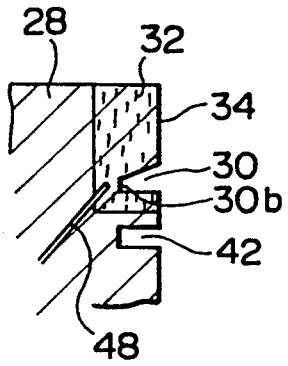
FIG. 40 is a schematic view of a piston showing the manner of mounting a thermocouple in the piston.

As is shown in FIG. 40, a thermocouple 48 of 0.1 mm diameter was mounted in the pistons (1)–(3) which were used in the durability test of the Example 15 so that the tip of the thermocouple was positioned at 0.2 mm inside from the bottom surface **30*b* of the top ring groove, and a diesel engine which incorporated these pistons was operated for 30 minutes under the same conditions as those of the durability test in the Example 15 to measure the temperature in the vicinity of the top ring groove and to determine its average temperature. As a result of the tests, the temperatures in the vicinity of the top ring groove were 210° C. in piston (1), 250° C. in piston (2) and 270° C. in piston (3)**, respectively.

From the results of this temperature measurement and the above-mentioned wear tests and durability tests, the following conclusions will be drawn:

(1) At a temperature below about 210° C., the composite materials A–C according to the prior art and the composite material according to the present invention have a good friction wear resistance. The material D including only aluminum alloy suffers a large amount of wear but no melt-adhesion yet occurs.

(2) At a temperature above 250° C., the composite material according to the present invention shows almost the same wear resistance as at a temperature below 210° C., while the composite materials A–C according to the prior art suffer heavy melt-adhesion and wear, and in a worst case ring-stick occurs. Consequently, in these composite materials according to the prior art, unallowable wear may occur as in aluminum alloys only consisting no reinforcing material.

(3) The composite material E does not suffer the melt-adhesion at high temperature above 250° C. as well as the composite material according to the present invention, but suffers a very heavy wear. In this composite material E, since the intermetallic compound which is effective to prevent the melt-adhesion and $Al_2O_3$ particles which cause the wear are both produced by a constant ratio, it is not possible to let good friction wear and good melt-adhesion resistance be compatible.

Example 17

Two pistons in which each top ring groove was positioned at the same position as in the piston 2 of the Example 15 and each lower surface of the top ring groove was defined by a composite material No. 4 and a composite material No. 5, respectively, were prepared according to the same manner as in Example 15, except that for the composite material No. 4 silicon carbide long fibers (alpha-SiC 99%, 20 microns mean fiber diameter) chopped to fibers of 2–3 mm are used, and for the composite material No. 5 silicon nitride whisker (alpha-$Si_3N_4$ 99%, 1 micron mean fiber diameter, 100 microns mean fiber length) were used, instead of the alumina short fibers in the Example 15. One more piston in which the top ring groove was positioned at the same position as in the Example 15 and the lower surface of the top ring groove was defined by a composite No. 6 was prepared according to the same manner as in the Example 15, except that cast iron short fibers (JIS FC23) of 20 microns mean fiber diameter and 3 mm mean fiber length were used at 20% by volume, instead of the alumina short fibers of the Example 15

These three pistons were then subjected to the durability test according to the same method and under the same conditions as in the Example 15. The results of the tests are shown in Table 15.

Table 15 shows that when cast iron short fibers were used as the reinforcing material the amounts of wear in the lower surface of the top ring groove and in the lower surface of the top ring increased to a relatively high level and some melt-adhesion wear occurred, while when silicon carbide fibers and silicon nitride whisker were used as the reinforcing material the amounts of wear in the lower surface of the top ring groove and in the lower surface of the top ring were both less and no melt-adhesion occurred, and therefore the composite materials including silicon carbide fibers or silicon nitride whisker as the reinforcing material could have a good wear resistance and a good melt-adhesion resistance. It was also found, though not shown in the table, that alumina-silica short fibers (52% $Al_2SiO_3$, 48% $SiO_2$, 3 mm mean fiber length, and 3 microns mean fiber diameter), silicon carbide whisker (99% beta-SiC, 50 microns mean fiber length, 0.1 micron mean fiber diameter), mineral short fibers (45% $SiO_2$, 40% CaO, 10% $Al_2O_3$, balance MgO, 2 mm mean fiber diameter, 5 microns mean fiber diameter), and glass fibers (64% $SiO_2$, 25% $Al_2O_3$, balance MgO, 5 mm mean fiber length, 10 microns mean fiber diameter) may also be used as the reinforcing material to obtain good wear resistance and good melt-adhesion resistance according to the present invention.

Example 18

Molded bodies were prepared by using the same Ni powder as used in the Example 15 and the same Co powder and Fe powder as used in the Example 16 at various rates so that the amounts of intermetallic compounds formed in the composite materials were substantially 0%, 5%, 10%, 20%, 30%, 40%, 50% and 60% by volume, respectively, as shown in Table 16, and pistons were prepared from these molded bodies so as each to have the top ring groove positioned at the same position as the piston (2) according to the same manner as in the Example 15, and the pistons were subjected to the durability test according to the same method and under the same conditions as in the Example 15. The results of the tests are shown in Table 17.

Table 17 shows that regardless of the types of the intermetallic compounds if the amount of the intermetallic compounds was less than 5% by volume, the melt-adhesion occurred, while if the amount of the intermetallic compounds was more than 60% by volume the matrix in the composite material became so brittle as to cause chipping off of the land portion of the piston. It is therefore understood that the volumetric ratio of the intermetallic compounds should preferably be 10–50%.

Example 19

Figure 41:
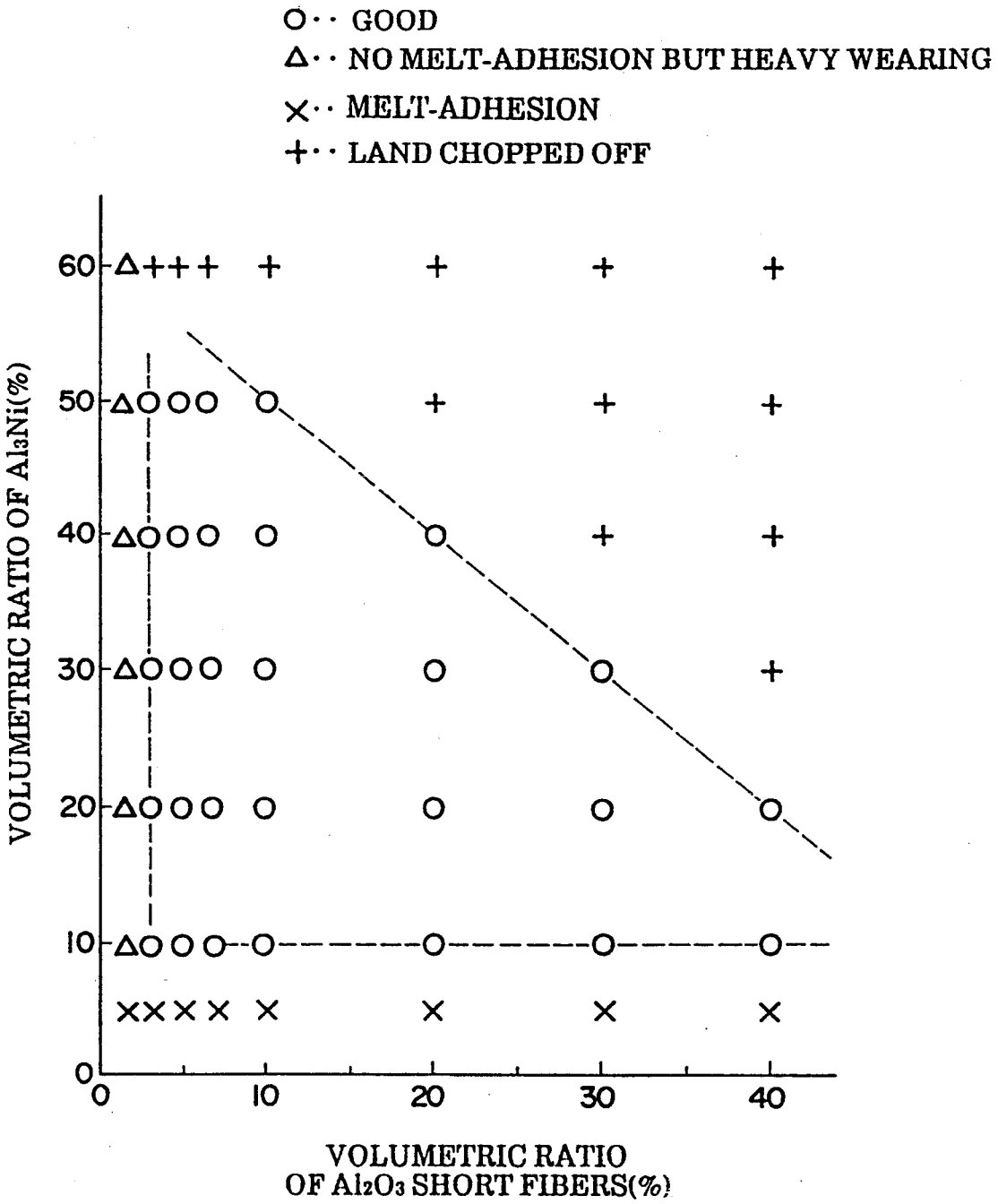
FIG. 41 is a graph showing the results of the durability test in Example 18.

Fifty six different molded bodies were prepared to include alumina short fibers at 2%, 3%, 5%, 10%, 20%, 30%, or 40% by volume and Ni powder at each of the ratios adopted in the Example 18 as shown in Table 16, and pistons were prepared by using those molded bodies according to the same manner as in the example so as to have the same dimensions as the piston (2) in the Example 15, and the pistons were subjected to the durability test according to the same method and under the same conditions as in the Example 15. The results of the tests are shown in FIG. 41. In FIG. 41, circles indicate that the melt-adhesion did not occur and the amount of the wear in the lower surface of the top ring groove was small triangles indicate that the melt-adhesion did not occur but the amount of the wear in the lower surface of the top ring groove exceeded 15 microns, Xes indicate that the melt-adhesion wear occurred, and pluses indicate that the land portion of the piston was chipped off.

FIG. 41 shows that in order to ensure good wear resistance and good melt-adhesion resistance in the lower surface of the top ring groove, the amount of alumina short fibers should preferably be more than 3% by volume, the amount of intermetallic compounds $Al_3Ni$ should preferably be 10–50% by volume, and the total amount of the alumina short fibers and the intermetallic compound $Al_3Ni$ should preferably be less than 60% by volume.

Further, additional tests were carried out according to the same method and under the same conditions as in this example by using the same silicon carbide fibers and silicon nitride whisker as used in the Example 17 as the reinforcing material and using the same Co powder and Fe powder as used in the Example 16 as the powder material incorporated in the molded bodies, and the same durability test as above were carried out. Although the results of the tests are not shown in the table, the results were substantially the same as those shown in FIG. 41.

Example 20

Molded bodies were prepared by using and mixing alloy powders and pure metal powders shown in Table 18, instead of Ni powder in the Example 15, so that the molded bodies included 5% alloy by volume when alloy was used or 5% pure metal by volume when pure metal was used, and each two piston preforms were prepared as shown in Table 19 from these molded bodies according to the same manner, as in the Example 15. By inspecting the structure in a cross section of the composite portion of one of each two piston preforms, the types of the intermetallic compounds dispersed in the matrix were determined. The results of the inspection are shown in Table 19.

Pistons were prepared from the other ones of the piston preforms to have the same dimensions as the piston (2) in the Example 15, and were subjected to the durability test according to the same method and under the same conditions as in the Example 15. As a result it was recognized that no unusual wearing such as melt-adhesion occurred in the lower surfaces of the top ring grooves of these pistons and the amount of wear was quite small.

Further, additional tests were carried out by modifying the volumetric ratio and the mixing ratio of powders in the molded bodies from those in Table 19 in order to see whether the melt-adhesion occurred or not, and the following conclusions were obtained:

If the following two conditions are satisfied, a piston shows excellent wear resistance and excellent melt-adhesion resistance in the lower surface of the top ring groove:

(1) Total amount of intermetallic compounds is more than 10% by volume.

(2) Intermetallic compounds made of Al and one or more metal elements selected from Fe, Co and Ni occupy more than 50% of the total intermetallic compounds.

When the above two conditions are satisfied, the same good results are obtained even if Cr, Mo, V, W, Nb or Ta is used as metal elements in addition to Fe, Co and Ni. If any other intermetallic compounds are included in addition to the intermetallic compounds of Al and one or more elements of Fe, Co and Ni, good results are obtained if the intermetallic compounds made of Al and one or more elements of Fe, Co and Ni occupy more than 10% by volume of the total intermetallic compounds.

Although the present invention has been described in detail with respect to several embodiments thereof, it will be understood by those skilled in the art that the present invention is not limited to these embodiments and other embodiments are possible without departing from the scope of the invention.

TABLE 1

| COMPOSITE MATERIAL No. | REINFORCING MATERIAL | | MATRIX | | INTERMETALLIC COMPOUND | |
|---|---|---|---|---|---|---|
| | TYPE | VOLUMETRIC RATIO | BASE COMPONENT | ADDITIVE ELEMENT | TYPE | VOLUMETRIC RATIO |
| 1 | $Al_2O_3$ short fibers | 10% | AC1A | — | — | — |
| 2 | $Al_2O_3$ short fibers | 10% | AC1A | 1%Ni | $NiAl_3$ | 5% |
| 3 | $Al_2O_3$ short fibers | 10% | AC1A | 2%Ni | $NiAl_3$ | 11% |
| 4 | $Al_2O_3$ short fibers | 10% | AC1A | 5%Ni | $NiAl_3$ | 30% |
| 5 | $Al_2O_3$ short fibers | 10% | AC1A | 7%Ni | $NiAl_3$ | 41% |
| 6 | $Al_2O_3$ short fibers | 10% | AC1A | 10%Ni | $NiAl_3$ | 55% |
| 7 | $Al_2O_3$ short fibers | 10% | AC1A | 15%Ni | $NiAl_3 + Ni_2Al_3$ | 68% |
| 8 | $Al_2O_3$ short fibers | 10% | AC1A | 18%Ni | $NiAl_3 + Ni_2Al_3$ | 80% |

TABLE 2

| COMPOSITE MATERIAL No. | REINFORCING MATERIAL | | MATRIX | | INTERMETALLIC COMPOUND | |
|---|---|---|---|---|---|---|
| | TYPE | VOLUMETRIC RATIO | BASE COMPONENT | ADDITIVE ELEMENT | TYPE | VOLUMETRIC RATIO |
| 9 | $Al_2O_3$ short fibers | 10% | 7075 | — | — | — |
| 10 | $Al_2O_3$ short fibers | 10% | AC8A | — | — | — |
| 11 | $Al_2O_3$ short fibers | 10% | ADC10 | — | — | — |
| 12 | $Al_2O_3$ short fibers | 10% | 7075 | 3%Ni | $NiAl_3$ | 18% |
| 13 | $Al_2O_3$ short fibers | 10% | AC8A | 3%Ni | $NiAl_3$ | 18% |
| 14 | $Al_2O_3$ short fibers | 10% | ADC10 | 3%Ni | $NiAl_3$ | 18% |

TABLE 3

| COMPOSITE MATERIAL No. | REINFORCING MATERIAL | | MATRIX | | INTERMETALLIC COMPOUND | |
|---|---|---|---|---|---|---|
| | TYPE | VOLUMETRIC RATIO | BASE COMPONENT | ADDITIVE ELEMENT | TYPE | VOLUMETRIC RATIO |
| 15 | $Al_2O_3$—SiO2 short fibers | 10% | 5056 | — | — | — |
| 16 | SiC whisker | 15% | 5056 | — | — | — |
| 17 | $Si_3N_4$ particles | 30% | 5056 | — | — | — |
| 18 | $Al_2O_3$—$SiO_2$ short fibers | 10% | 5056 | 5%Ni | $NiAl_3$ | 30% |
| 19 | SiC whisker | 15% | 5056 | 5%Ni | $NiAl_3$ | 30% |
| 20 | $Si_3N_4$ particles | 30% | 5056 | 5%Ni | $NiAl_3$ | 30% |

TABLE 4

| COMPOSITE MATERIAL No. | REINFORCING MATERIAL | | MATRIX | | INTERMETALLIC COMPOUND | |
|---|---|---|---|---|---|---|
| | TYPE | VOLUMETRIC RATIO | BASE COMPONENT | ADDITIVE ELEMENT | TYPE | VOLUMETRIC RATIO |
| 21 | $Si_3N_4$ whisker | 10% | AC5A | — | — | — |
| 22 | $Si_3N_4$ whisker | 10% | AC5A | 5%Fe | $FeAl_3$ | 31% |
| 23 | $Si_3N_4$ whisker | 10% | AC5A | 3%Co | $Co_2Al_9$ | 29% |
| 24 | $Si_3N_4$ whisker | 10% | AC5A | 3%Mn | $MnAl_6$ | 30% |
| 25 | $Si_3N_4$ whisker | 10% | AC5A | 7%Ti | $TiAl_3$ | 30% |

TABLE 5

| COMPOSITE MATERIAL No. | REINFORCING MATERIAL | | MATRIX | | INTERMETALLIC COMPOUND | |
|---|---|---|---|---|---|---|
| | TYPE | VOLUMETRIC RATIO | BASE COMPONENT | ADDITIVE ELEMENT | TYPE | VOLUMETRIC RATIO |
| 26 | $Al_2O_3$ particles | 30% | ADC7 | — | — | — |
| 27 | $Al_2O_3$ particles | 30% | ADC7 | 3% Fe—Mn | $FeMnAl_6$ | 30% |
| 28 | $Al_2O_3$ particles | 30% | ADC7 | 1.6% Ni—Fe | $FeNiAl_9$ | 29% |
| 29 | $Al_2O_3$ particles | 30% | ADC7 | 7.8% Ni—Cu | $(NiCu)_2Al_3$ | 31% |
| 30 | $Al_2O_3$ particles | 30% | ADC7 | 9.3% Cu—Zn | $Cu_5Zn_2Al_3$ | 30% |

TABLE 6

| COMPOSITE MATERIAL No. | REINFORCING MATERIAL TYPE | REINFORCING MATERIAL VOLUMETRIC RATIO | MATRIX BASE COMPONENT | MATRIX ADDITIVE ELEMENT | INTERMETALLIC COMPOUND TYPE | INTERMETALLIC COMPOUND VOLUMETRIC RATIO |
|---|---|---|---|---|---|---|
| 31 | Glass fibers | 5% | AC4C | — | — | — |
| 32 | Glass fibers | 5% | AC4C | 5%Fe | $FeAl_3$ | 28% |
| 33 | Glass fibers | 5% | AC4C | 5%Fe | $FeAl_3$ | 28% |
| 34 | Glass fibers | 5% | AC4C | 5%Fe | $FeAl_3$ | 28% |
| 35 | Glass fibers | 5% | AC4C | 5%Fe | $FeAl_3$ | 28% |
| 36 | Glass fibers | 5% | AC4C | 5%Fe | $FeAl_3$ | 28% |
| 37 | Glass fibers | 5% | AC4C | 5%Fe | $FeAl_3$ | 28% |
| 38 | Glass fibers | 5% | AC4C | 5%Fe | $FeAl_3$ | 28% |

TABLE 7

| COMPOSITE MATERIAL No. | REINFORCING MATERIAL TYPE | REINFORCING MATERIAL VOLUMETRIC RATIO | MATRIX BASE COMPONENT | MATRIX ADDITIVE ELEMENT | INTERMETALLIC COMPOUND TYPE | INTERMETALLIC COMPOUND VOLUMETRIC RATIO |
|---|---|---|---|---|---|---|
| 39 | SiC whisker | 10% | AC8A | — | — | — |
| 40 | SiC whisker | 10% | AC8A | 5%Ni | $Al_3Ni$ | 30% |
| 41 | SiC whisker | 10% | AC8A | 5%Mg | $Mg_2Al_3$ | 30% |
| 42 | SiC whisker | 10% | AC8A | 5%Cu | $CuAl_2$ | 30% |
| 43 | SiC whisker | 10% | AC8A | 5%Cr | $CrAl_7$ | 30% |
| 44 | SiC whisker | 10% | AC8A | 5%Fe | $FeAl_3$ | 30% |
| 45 | SiC whisker | 10% | AC8A | 5%Ti | $TiAl_3$ | 30% |

TABLE 8

| COMPOSITE MATERIAL No. | REINFORCING MATERIAL TYPE | REINFORCING MATERIAL COMPOSITION |
|---|---|---|
| 46 | Cast iron short fibers | JIS FC25 |
| 47 | Potassium titanate whisker | $K_20.6TiO_2$ |
| 48 | Chopped glass fibers | E glass |
| 49 | $Al_2O_3$—$SiO_2$ short fibers | Noncrystalline $Al_2O_3$—48%SiO |
| 50 | $Al_2O_3$ short fibers | $Al_2O_3$—5%$SiO_2$* |
| 51 | $Al_2O_3$ short fibers | $Al_2O_3$—5%$SiO_2$** |
| 52 | $Si_3N_4$ whisker | beta-$Si_3N_4$ |
| 53 | Chopped $Al_2O_3$ fibers | alpha-$Al_2O_3$ |
| 54 | SiC whisker | beta-Sic |

| No. | MEAN FIBER DIAMETER | MEAN FIBER LENGTH | HARDNESS (Hv) |
|---|---|---|---|
| 46 | 15 micron | 3 mm | 270 |
| 47 | 0.3 micron | 30 micron | 400 |
| 48 | 10 micron | 5 mm | 600 |
| 49 | 3 micron | 2 mm | 700 |
| 50 | 2 micron | 2 mm | 1050 |
| 51 | 2 micron | 2 mm | 1300 |
| 52 | 0.3 micron | 200 micron | 1800 |
| 53 | 20 micron | 2 mm | 2200 |
| 54 | 0.2 micron | 40 micron | 3300 |

* . . . alpha-$AAl_2O_3$50% + delta-$Al_2O_3$50%
** . . . alpha-$Al_2O_3$90% + delta-$Al_2O_3$10%

TABLE 9

| POWDER | INTERMETALLIC COMPOUND | VOLUMETRIC RATIO OF INTERMETALLIC COMPOUND (%) | MELT-ADHESION AREA RATIO (%) |
|---|---|---|---|
| Cr | $CrAl_7$ | 30 | 22 |
| Mo | $MoAl_{12}$ + $MoAl_3$ | 30 | 23 |
| V | $VAl_{11}$ + $VAl_6$ | 30 | 23 |
| W | $WAl_{12}$ + $WAl_5$ | 30 | 25 |
| Ta | $TaAl_3$ | 30 | 22 |
| Nb | $NbAl_3$ | 30 | 20 |
| Zn | $ZrAl_3$ | 30 | 20 |
| Cu | $CuAl_2$ | 30 | 24 |

TABLE 10

| INTERMETALLIC COMPOUND | VOLUMETRIC RATIO OF INTERMETALLIC COMPOUND (%) | MELT-ADHESION AREA RATIO (%) |
|---|---|---|
| $NiAl_3$ + $TiAl_3$ | 30 | 19 |
| $FeAl_3$ + $NiAl_3$ | 30 | 18 |
| $CrAl_7$ + $Co_2Al_9$ | 30 | 20 |
| $NiAl_3$ + $FeAl_3$ + $TiAl_3$ | 30 | 18 |
| $FeAl_3$ + $VAl_{11}$ | 30 | 22 |
| $TiAl_3$ + $TaAl_3$ | 30 | 20 |
| $CrAl_7$ + $NbAl_3$ | 30 | 21 |
| $TaAl_3$ + $NbAl_3$ | 30 | 19 |
| $TaAl_3$ + $ZrAl_3$ | 30 | 20 |
| $FeAl_3$ + $TiAl_3$ + $ZrAl_3$ | 30 | 21 |
| $Co_2Al_9$ + $CuAl_2$ | 30 | 24 |

TABLE 11

| No. | Temperature of molten matrix | Ratio of needle shaped intermetallic compounds |
|---|---|---|
| 3 | 850° C. | 60% |
| 4 | 840° C. | 50% |
| 5 | 830° C. | 40% |
| 6 | 820° C. | 30% |
| 7 | 810° C. | 25% |
| 2 | 800° C. | 20% |
| 1 | 750° C. | 0% |

TABLE 12

| No. | Temperature of mold (°C.) | Width of X structure (mm) |
|---|---|---|
| 8 | 400 | 0 |
| 9 | 350 | 0.5 |
| 10 | 300 | 1.0 |
| 11 | 250 | 1.5 |
| 12 | 200 | 2 |
| 13 | 150 | 3 |
| 14 | 100 | 4 |

TABLE 13

| Fibers | Powder | Ratio of fibers/powder by weight |
|---|---|---|
| SiC short fibers[1)] | Fe | 1:1.23 |
| $Si_3N_4$ short fibers[2)] | Co | 1:1.40 |
| Carbon short fibers[3)] | Cr | 1:2.00 |
| $Al_2O_3$—$SiO_2$ short fibers[4] | Mo | 1:1.96 |
| Glass fibers[5)] | Mn | 1:1.54 |
| Mineral fibers[6)] | V | 1:1.27 |
| Stainless steel short fibers[7)] | Ti | 1:0.29 |
| Cast iron short fibers[8)] | Zr | 1:0.45 |

Notes:
1) Beta-SiC, 10 microns mean fiber diameter, 2–3 mm mean fiber length, chopped fibers
2) Beta-$Si_3N_4$, 0.2–0.5 micron mean fiber diameter, 100 microns mean fiber length
3) Pan type, 12 microns mean fiber diameter, 3 mm mean fiber length, chopped fibers
4) 47% $Al_2O_3$, 53% $SiO_2$, 2–3 microns fiber diameter, 2–3 mm fiber length
5) E-glass, 10 microns mean fiber diameter, 5 mm mean fiber length, chopped fibers
6) 40% CaO, 10% MgO, balance $SiO_2$, 5 microns mean fiber diameter, 2–3 mm mean fiber length
7) 20 microns mean fiber diameter, 3 mm mean fiber length, chopped fibers
8) 30 microns mean fiber diameter, 3 mm mean fiber length, chopped fibers

TABLE 14

| COMPOSITE MATERIAL | POSITION OF LOWER SURFACE OF RING GROOVE | AMOUNT OF WEAR IN LOWER SURFACE OF RING GROOVE (micron) | AMOUNT OF WEAR IN LOWER SURFACE OF RING (micron) | OCCURRENCE OF MELT-ADHESION |
|---|---|---|---|---|
| No. 1 | 1 | 2 | 0.5 | ○ |
| | 2 | 3 | 0.4 | ○ |
| | 3 | 2 | 0.5 | ○ |
| No. 2 | 1 | 3 | 0.5 | ○ |
| | 2 | 3 | 0.5 | ○ |
| | 3 | 4 | 0.6 | ○ |
| No. 3 | 1 | 3 | 0.4 | ○ |
| | 2 | 3 | 0.5 | ○ |
| | 3 | 3 | 0.5 | ○ |
| A | 1 | 8 | 3 | ○ |
| | 2 | 89 | 4 | X |
| | 3 | *108 | 7 | X |
| B | 1 | 11 | 2 | ○ |
| | 2 | *103 | 4 | X |
| | 3 | *118 | 3 | X |
| C | 1 | 14 | 1 | ○ |
| | 2 | *128 | 2 | X |
| | 3 | *119 | 4 | X |
| D | 1 | 85 | 6 | ○/X |
| | 2 | *143 | 6 | X |
| | 3 | *148 | 7 | X |
| E | 1 | 43 | 35 | ○/X |
| | 2 | 45 | 40 | ○/X |
| | 3 | 44 | 43 | ○/X |

* . . . Ring stick occurred
○ . . . No Melt-adhesion occurred
X . . . Melt-adhesion occurred

TABLE 15

| COMPOSITE MATERIAL | POSITION OF LOWER SURFACE OF RING GROOVE | AMOUNT OF WEAR IN LOWER SURFACE OF RING GROOVE (micron) | AMOUNT OF WEAR IN LOWER SURFACE OF RING (micron) | OCCURRENCE OF MELT-ADHESION |
|---|---|---|---|---|
| No. 4 | 2 | 3 | 2 | ○ |
| No. 5 | 2 | 2 | 2 | ○ |
| No. 6 | 2 | 80 | 10 | X |

○ . . . No Melt-adhesion occurred
X . . . Melt-adhesion occurred

TABLE 16

| | VOLUMETRIC RATIO OF INTERMETALLIC COMPOUND (%) | | | | | | | |
|---|---|---|---|---|---|---|---|---|
| | 0 | 5 | 10 | 20 | 30 | 40 | 50 | 60 |
| VOLUMETRIC RATIO OF Ni POWDER (%) | 0 | 0.93 | 1.9 | 3.7 | 5.6 | 7.4 | 9.2 | 11.1 |
| VOLUMETRIC RATIO OF Co POWDER (%) | 0 | 0.67 | 1.3 | 2.7 | 4.0 | 5.3 | 6.7 | 8.0 |
| VOLUMETRIC RATIO OF Fe POWDER (%) | 0 | 0.89 | 1.8 | 3.6 | 5.3 | 7.1 | 8.9 | 10.7 |

TABLE 17

| TYPE OF INTER-METALLIC COMPOUND | VOLUMETRIC RATIO OF INTERMETALLIC COMPOUND (%) | | | | | | | |
|---|---|---|---|---|---|---|---|---|
| | 0 | 5 | 10 | 20 | 30 | 40 | 50 | 60 |
| $Al_3Ni$ | X | X | ○ | ○ | ○ | ○ | ○ | + |
| $Al_9Co_2$ | X | X | ○ | ○ | ○ | ○ | ○ | + |
| $Al_3Fe$ | X | X | ○ | ○ | ○ | ○ | ○ | + |

○ . . . No Melt-adhesion occurred
X . . . Melt-adhesion occurred

+ . . . Land portion chipped off

TABLE 18

| TYPE OF POWDER | PURITY (%) | MEAN PARTICLE SIZE (micron) |
|---|---|---|
| Ni—50%Fe | 99 | 12 |
| Ni—50%Co | 99 | 12 |
| Fe—50%Co | 99 | 10 |
| Ni—30%Cu | 99 | 10 |
| Fe—20%Mn | 99 | 10 |
| Cu | 99 | 15 |
| Mn | 99 | 10 |
| Ti | 99 | 10 |

TABLE 19

| | REINFORCING MATERIAL | | FIRST POWDER | | SECOND POWDER | |
|---|---|---|---|---|---|---|
| No. | TYPE | VOLUMETRIC RATIO (%) | TYPE | VOLUMETRIC RATIO (%) | TYPE | VOLUMETRIC RATIO (%) |
| 1 | $Al_2O_3$ short fibers | 7 | Ni—50Fe | 5 | — | — |
| 2 | $Al_2O_3$ short fibers | 7 | Fe—50Co | 5 | — | — |
| 3 | $Al_2O_3$ short fibers | 7 | Co—50Ni | 5 | — | — |
| 4 | $Al_2O_3$ short fibers | 7 | Ni—30Cu | 5 | — | — |
| 5 | $Al_2O_3$ short fibers | 7 | Fe—20Mn | 5 | — | — |
| 6 | $Al_2O_3$ short fibers | 7 | Ni | 3 | Fe | 2 |
| 7 | $Al_2O_3$ short fibers | 7 | Co | 2 | Ni | 2 |
| 8 | $Al_2O_3$ short fibers | 7 | Ni | 4 | Cu | 1 |
| 9 | $Al_2O_3$ short fibers | 7 | Fe | 4 | Mn | 1 |
| 10 | $Al_2O_3$ short fibers | 7 | Fe | 4 | Ti | 1 |

| No. | INTERMETALLIC COMPOUND GENERATED |
|---|---|
| 1 | $NiFeAl_9$ |
| 2 | $FeCoAl_4$ |
| 3 | $NiCoAl_4$ |
| 4 | $(NiCu)_2Al_3 + NiAl_3$ |
| 5 | $FeMnAl_6 + FeAl_3$ |
| 6 | $FeNiAl_9 + NiAl_3 + FeAl_3$ |
| 7 | $NiCoAl_4 + Co_2Al_9 + NiAl_3$ |
| 8 | $(NiCu)_2Al_3 + NiAl_3$ |
| 9 | $FeMnAl_6 + FeAl_3 + MnAl_6$ |
| 10 | $FeTiAl_6 + FeAl_3 + TiAl_3$ |

We claim:

1. An aluminum alloy material including a local portion reinforced to form a composite material comprising a matrix of an aluminum alloy, a reinforcing material of short fibers, whiskers or particles, and intermetallic compounds made of Al and at least one metallic element selected from the group consisting of Fe, Ni, Co, Cr, Cu, Mn, Mo, V, W, Ta, Nb, Ti and Zr as finely dispersed in the matrix at 5–70% by volume, said aluminum alloy material having been manufactured by forming a porous body of a mixture of said reinforcing material and a powder of said selected metallic element or elements, placing said porous body in a molding cavity of a casting mold, charging a molten body of said aluminum alloy into said molding cavity, and infiltrating a pan of said molten body of said aluminum alloy into said porous body.

2. An aluminum alloy composite material according to claim 1, wherein the amount of reinforcing material is selected to be 3–30% by volume.

3. An aluminum alloy composite material according to claim 1, wherein the amount of the intermetallic compounds in the matrix is selected to be 10–40% by volume.

4. An aluminum alloy material according to claim 1, wherein the average closest distance between the intermetallic compounds is 3–100 microns.

5. An aluminum alloy composite material according to claim 1, wherein the closest distance between the intermetallic compounds is selected to be 5–50 microns.

6. An aluminum alloy composite material according to claim 1, wherein the hardness of the intermetallic compound is more than 300 in Vicker's hardness and less than that of reinforcing material.

7. An aluminum alloy composite material according to claim 1, wherein the intermetallic compounds are in the form of particles, and the maximum particle size is less than 50 microns.

8. An aluminum alloy composite material according to claim 1, wherein the intermetallic compounds are in the form of particles, and the maximum particle size is less than 30 microns.

9. An aluminum alloy composite material according to claim 1, wherein the intermetallic compounds are in the form of needles, and the maximum length is less than 100 microns.

10. An aluminum alloy composite material according to claim 1, wherein the intermetallic compounds are in the form of needles, and the maximum length is less than 50 microns.

11. An aluminum alloy casting comprising a local composite material portion which defines a surface portion of said aluminum alloy casting, said composite material portion comprising a matrix of an aluminum alloy, a reinforcing material of short fibers or whiskers, and intermetallic compounds made of Al and at least one metallic element selected from the group consisting of Fe, Ni, Co, Cr, Mn, Mo, V, W, Ta, Nb, Ti and Zr as finely dispersed in the matrix, wherein as viewed in a surface portion of the casting the ratio by area of such intermetallic compounds having a ratio of L/D greater than 3 is less than 30%, where L and D are length and width of each intermetallic compound element, respectively, said aluminum alloy casting having been manufactured by forming a porous body of a mixture of said reinforcing material and a powder of said selected metallic element or elements, placing said porous body adjacent a wall of a molding cavity of a casting mold, charging a molten body of said aluminum alloy into said molding cavity, and infiltrating a part of said molten body of said aluminum alloy charged in said molding cavity into said porous body.

12. An aluminum alloy casting according to claim 11, wherein the amount of the reinforcing material is selected to be 3–50% by volume, and the amount of the intermetallic compounds is selected to be 5–60% by volume.

13. An aluminum alloy casting according to claim 11, wherein the average closest distance between each two adjacent intermetallic compounds is 3–100 microns.

14. An aluminum alloy casting according to claim 11, wherein the average closest distance between each two adjacent intermetallic compounds is 5–50 microns.

15. An aluminum alloy casting according to claim 11, wherein the hardness of the intermetallic compounds is more than 300 by Vicker's hardness and less than that of the reinforcing material.

16. An aluminum alloy casting according to claim 11, wherein the intermetallic compounds are particles, and the maximum diameter is less than 50 microns.

17. An aluminum alloy casting according to claim 11, wherein the intermetallic compounds are particles, and the maximum diameter is less than 30 microns.

18. An aluminum alloy casting according to claim 11, wherein the intermetallic compounds are needles, and the maximum length is less than 100 microns.

19. An aluminum alloy casting according to claim 11, wherein the intermetallic compounds needles, and the maximum length is less than 50 microns.

20. A piston for an internal combustion engine of an aluminum alloy, wherein at least a lower surface of a top ring groove is defined by a composite material comprising a matrix of said aluminum alloy, a reinforcing material of short fibers, whiskers of particles, and intermetallic compounds made of Al and at least one element selected from the group consisting of Fe, Ni, Co, Cr, Cu, Mn, Mo, V, W, Ta, Nb, Ti and Zr, the amount of said reinforcing material in said composite materials being more than 3% by volume, the amount of said intermetallic compounds being 10–15% BY volume, and the total amount of said reinforcing material and said intermetallic compounds being less than 60% by volume, said piston having been manufactured by forming an annular porous body of a mixture of said reinforcing material and powder of said selected metallic element or elements, placing said annular porous body along an annular corner of a cylindrical molding cavity of a casting mold, charging a molten body of said aluminum alloy into said molding cavity, infiltrating a part of said molten body of said aluminum alloy charged into said molding cavity into said porous body, and cutting said top ring groove in a portion of a cast body incorporating said porous body therein.

21. A piston according to claim 20, wherein the amount of reinforcing material is 3–40% by volume.

22. A piston according to claim 20, wherein the amount of reinforcing material is 3–30% by volume.

23. A piston according to claim 20, wherein the amount of the intermetallic compounds which are made of Al and one or more metal elements selected from Fe, Co and Ni is more than 50% of the intermetallic compounds by volume, and the amount thereof is more than 10% of the composite material by volume.

24. A piston according to claim 20, wherein the average closest distance between two adjacent intermetallic compound elements is 3–100 microns.

25. A piston according to claim 20, wherein the average closest distance between two adjacent intermetallic compound elements is 5–50 microns.

26. A piston according to claim 20, wherein the intermetallic compounds are in the form of particles, and the maximum particle size is less than 50 microns.

27. A piston according to claim 20, wherein the intermetallic compounds are in the form of particles, and the maximum particle size is less than 30 micron meter.

28. A piston according to claim 20, wherein the intermetallic compounds are formed in a needle form, and the maximum length thereof is less than 100 microns.

29. A piston according to claim 20, wherein the intermetallic compounds are formed in the form of needles, and the maximum length thereof is less than 50 microns.

30. A piston according to claim 20, wherein the intermetallic compounds are in the form of particles, and the maximum grain size is 50 microns.

31. A piston according to claim 20, wherein the intermetallic compounds are in the form of particles, and the maximum grain size is 30 microns.

* * * * *

UNITED STATES PATENT AND TRADEMARK OFFICE

CERTIFICATE OF CORRECTION

PATENT NO. : 5,449,421

DATED : September 12, 1995

INVENTOR(S) : Kaneo HAMAJIMA, et al.

It is certified that error appears in the above-indentified patent and that said Letters Patent is hereby corrected as shown below:

Column 1, line 29, change "weigh" to --weight--.

Column 1, line 34, change "Laying-open" to --Laid-open--.

Column 1, line 59, delete the comma after "if".

Column 2, line 57, change "Laying-open" to --Laid-open--.

Column 3, line 14, change "sever" to --severe--.

Column 3, line 25, change "Laying-open" to --Laid-open--.

Column 3, line 29, change "Laying-open" to --Laid-open--.

Column 4, line 22, change "Laying-open" to --Laid-open--.

Column 4, line 25, change "Laying-open" to --Laid-open--.

UNITED STATES PATENT AND TRADEMARK OFFICE

CERTIFICATE OF CORRECTION

PATENT NO. : 5,449,421 Page 2 of 6

DATED : September 12, 1995

INVENTOR(S) : Kaneo HAMAJIMA, et al.

It is certified that error appears in the above-indentified patent and that said Letters Patent is hereby corrected as shown below:

Column 4, line 33, change "tile" to --the--.

Column 5, line 14, change "al least" to --at least--.

Column 8, line 45, insert --one-- before "element".

Column 9, line 36, change "he" to --the--.

Column 11, line 20, change "pressured" to --pressure--.

Column 12, line 54, change "used in common" to --commonly used--.

Column 12, line 58, change "about" to --on--.

Column 13, line 24, delete "the".

Column 14, line 5, change "guessed" to --suspected--.

Column 14, line 29, change "by such" to --in such--.

Column 14, line 62, change "as far as" to --as long as--.

Column 16, line 65, delete the comma after "average" and insert an opening parenthesis before "5 mm".

UNITED STATES PATENT AND TRADEMARK OFFICE

CERTIFICATE OF CORRECTION

PATENT NO. : 5,449,421 Page 3 of 6

DATED : September 12, 1995

INVENTOR(S) : Kaneo HAMAJIMA, et al.

It is certified that error appears in the above-indentified patent and that said Letters Patent is hereby corrected as shown below:

Column 17, line 37, change "tile" to --the--.

Column 18, line 9, change "as far as" to --as long as--.

Column 18, line 10, change "has" to --have--.

Column 18, line 27, change "prepare" to --prepared--.

Column 18, line 30, change "prepare" to --prepared--.

Column 19, line 28, delete "+" before "in" at beginning of line.

Column 19, line 56, change "34, 54, 104, 204, 404, 504, 604, 704" to --3%, 5%, 10%, 20%, 30%, 40%, 50%, 60%, 70%--.

Column 19, line 57, change "804" to --80%--.

Column 20, line 10, insert --of-- after "volume" and --in-- after "used".

Column 20, line 14, insert --of-- after "volume"

Column 20, line 23, change "$BAl_3Ni$" to --B $Al_3Ni$--.

UNITED STATES PATENT AND TRADEMARK OFFICE

CERTIFICATE OF CORRECTION

PATENT NO. : 5,449,421

DATED : September 12, 1995

INVENTOR(S) : Kaneo HAMAJIMA, et al.

It is certified that error appears in the above-indentified patent and that said Letters Patent is hereby corrected as shown below:

Column 20, line 27, change "guessed" to --suspected--.

Column 21, line 21, change "examination" to --examining--.

Column 21, line 46, after "carried" insert --out--.

Column 22, line 1, change "as far as" to --as long as--.

Column 22, line 12, delete "and".

Column 22, line 41, change "characteristic" to --characteristics--.

Column 23, line 35, between "After" and "removed" insert --they were--.

Column 24, line 34, after "were" insert --in-- and delete "a".

Column 24, line 35, at beginning of line delete "in" before "disk shape," and insert --a--.

UNITED STATES PATENT AND TRADEMARK OFFICE

CERTIFICATE OF CORRECTION

PATENT NO. : 5,449,421 Page 5 of 6

DATED : September 12, 1995

INVENTOR(S) : Kaneo HAMAJIMA, et al.

It is certified that error appears in the above-indentified patent and that said Letters Patent is hereby corrected as shown below:

Column 25, line 15, delete "the" right before "portion" at end of line.

Column 25, line 22, delete "to" after "cut out".

Column 25, line 64, change "28" to --28a--.

Column 27, line 54, changed "guessed" to --suspected--.

Column 27, line 60, change "contend" to --content--.

Column 28, line 22, change "will be drawn:" to --were drawn:--.

Column 28, line 38, change "only consisting" to --consisting of--.

Column 30, line 7, after "small" insert a semi-colon.

Column 33, line 53, change "alpha-AAl2 O3 50%" to --alpha-$Al_2O_e$50%--.

Column 39, line 23, insert --are-- after "compounds".

UNITED STATES PATENT AND TRADEMARK OFFICE

CERTIFICATE OF CORRECTION

PATENT NO. : 5,449,421

DATED : September 12, 1995

INVENTOR(S) : Kaneo HAMAJIMA, et al.

It is certified that error appears in the above-indentified patent and that said Letters Patent is hereby corrected as shown below:

Column 39, line 29, change "of particles" to --or particles--.

Column 39, line 35, change "BY" to --by--.

Column 40, line 29, change "micron meter." to --microns--.

Signed and Sealed this

Thirtieth Day of January, 1996

*Attest:*

BRUCE LEHMAN

*Attesting Officer*

*Commissioner of Patents and Trademarks*